US010157520B2

(12) United States Patent
Marston

(10) Patent No.: US 10,157,520 B2
(45) Date of Patent: Dec. 18, 2018

(54) GAMING SYSTEM AND METHOD FOR PROVIDING A MULTIPLE LEVEL SELECTION GAME

(71) Applicant: IGT, Las Vegas, NV (US)

(72) Inventor: Daniel W. Marston, Reno, NV (US)

(73) Assignee: IGT, Las Vegas, NV (US)

( * ) Notice: Subject to any disclaimer, the term of this patent is extended or adjusted under 35 U.S.C. 154(b) by 198 days.

(21) Appl. No.: 14/817,861

(22) Filed: Aug. 4, 2015

(65) Prior Publication Data

US 2016/0093162 A1 Mar. 31, 2016

Related U.S. Application Data

(60) Provisional application No. 62/056,735, filed on Sep. 29, 2014.

(51) Int. Cl.
*G07F 17/00* (2006.01)
*G07F 17/32* (2006.01)

(52) U.S. Cl.
CPC ..... *G07F 17/3267* (2013.01); *G07F 17/3258* (2013.01)

(58) Field of Classification Search
CPC ..... G07F 17/32; G07F 17/34
See application file for complete search history.

(56) References Cited

U.S. PATENT DOCUMENTS 4,182,515 A 1/1980 Nemeth
4,624,459 A 11/1986 Kaufman
4,695,053 A 9/1987 Vazquez, Jr. et al.
4,991,848 A 2/1991 Greenwood et al.
5,046,737 A 9/1991 Fienberg
5,083,787 A 1/1992 Petre
5,092,598 A 3/1992 Kamille
5,116,055 A 5/1992 Tracy
5,205,555 A 4/1993 Hamano
5,324,041 A 6/1994 Boylan et al.
5,342,047 A 8/1994 Heidel et al.
5,380,007 A 1/1995 Travis et al.
5,449,173 A 9/1995 Thomas et al.
5,456,465 A 10/1995 Durham
5,536,016 A 7/1996 Thompson
(Continued)

FOREIGN PATENT DOCUMENTS

EP 0874337 10/1998
EP 0945837 3/1999
(Continued)

*Primary Examiner* — Reginald Renwick
(74) *Attorney, Agent, or Firm* — Neal, Gerber & Eisenberg LLP

(57) ABSTRACT

A gaming system which displays a play of a multiple level selection game. For each level, the gaming system displays a plurality of selections associated with that level. A player picks a quantity of the selections as player picks. The player designates one or more of the player picks as designated picks. One or more modifiers are applied to each of the designated picks. The gaming system modifies the awards associated with the designated picks based on the one or more modifiers associated with each of the designated picks. The gaming system provides the value of the awards associated with the player picks. If the total value of the awards is greater than a threshold value for the currently played level, the gaming system provides the play of the next level and repeats the selection game.

25 Claims, 10 Drawing Sheets

(56) References Cited

U.S. PATENT DOCUMENTS 5,542,669 A 8/1996 Charron et al.
5,611,535 A 3/1997 Tiberio
5,647,798 A 7/1997 Falciglia
5,769,716 A 6/1998 Saffari et al.
5,788,573 A 8/1998 Baerlocher et al.
5,833,536 A 11/1998 Davids et al.
5,833,537 A 11/1998 Barrie
5,833,538 A 11/1998 Weiss
5,851,148 A 12/1998 Brune et al.
5,855,514 A 1/1999 Kamille
5,873,781 A 2/1999 Keane
5,919,088 A 7/1999 Weiss
5,947,820 A 9/1999 Morro et al.
5,964,463 A 10/1999 Moore, Jr.
5,980,384 A 11/1999 Barrie
5,984,781 A 11/1999 Sunaga
5,997,400 A 12/1999 Seelig et al.
5,997,401 A 12/1999 Crawford
6,004,207 A 12/1999 Wilson, Jr. et al.
6,015,346 A 1/2000 Bennett
6,016,338 A 1/2000 Bansal et al.
6,033,307 A 3/2000 Vancura
6,045,129 A 4/2000 Cooper et al.
6,059,289 A 5/2000 Vancura
6,089,976 A 7/2000 Schneider et al.
6,089,977 A 7/2000 Bennett
6,093,102 A 7/2000 Bennett
6,102,798 A 8/2000 Bennett
6,120,031 A 9/2000 Adams
6,126,542 A 10/2000 Fier
6,126,547 A 10/2000 Ishimoto
6,135,885 A 10/2000 Lermusiaux
6,149,156 A 11/2000 Feola
6,155,925 A 12/2000 Giobbi et al.
6,159,095 A 12/2000 Frohm et al.
6,159,097 A 12/2000 Gura
6,159,098 A 12/2000 Slomiany et al.
6,162,121 A 12/2000 Morro et al.
6,164,652 A 12/2000 Lauretta et al.
6,165,070 A 12/2000 Nolte et al.
6,168,520 B1 1/2001 Baerlocher et al.
6,168,523 B1 1/2001 Piechowiak et al.
6,173,955 B1 1/2001 Perrie et al.
6,174,235 B1 1/2001 Walker et al.
6,186,894 B1 2/2001 Mayeroff
6,190,254 B1 2/2001 Bennett
6,190,255 B1 2/2001 Thomas et al.
6,203,429 B1 3/2001 Demar et al.
6,213,876 B1 4/2001 Moore, Jr.
6,213,877 B1 4/2001 Walker et al.
6,224,483 B1 5/2001 Mayeroff
6,231,442 B1 5/2001 Mayeroff
6,231,445 B1 5/2001 Acres
6,234,897 B1 5/2001 Frohm et al.
6,261,177 B1 7/2001 Bennett
6,270,409 B1 8/2001 Shuster
6,299,165 B1 10/2001 Nagano
6,309,300 B1 10/2001 Glavich
6,312,334 B1 11/2001 Yoseloff
6,315,660 B1 11/2001 DeMar et al.
6,315,664 B1 11/2001 Baerlocher et al.
6,319,124 B1 11/2001 Baerlocher et al.
6,328,649 B1 12/2001 Randall et al.
6,346,043 B1 2/2002 Colin et al.
6,347,996 B1 2/2002 Gilmore et al.
6,364,766 B1 4/2002 Anderson et al.
6,364,767 B1 4/2002 Brossard et al.
6,364,768 B1 4/2002 Acres et al.
6,368,218 B2 4/2002 Angell, Jr.
6,394,907 B1 5/2002 Rowe
6,398,645 B1 6/2002 Yoseloff
6,406,369 B1 6/2002 Baerlocher et al.
6,435,500 B2 8/2002 Guimina
6,439,995 B1 8/2002 Hughs-Baird et al.
6,443,837 B1 9/2002 Jaffe et al.
6,450,883 B1 9/2002 O'Halloran
6,464,582 B1 10/2002 Baerlocher et al.
6,491,584 B2 12/2002 Graham et al.
6,494,785 B1 12/2002 Gerrard et al.
6,511,375 B1 1/2003 Kaminkow
6,547,242 B1 4/2003 Sugiyama et al.
6,561,899 B2 5/2003 Vancura
6,582,307 B2 6/2003 Webb
6,589,115 B2 7/2003 Walker et al.
6,595,854 B2 7/2003 Hughs-Baird et al.
6,599,185 B1 7/2003 Kaminkow et al.
6,602,135 B1 8/2003 Gerrard
6,602,137 B2 8/2003 Kaminkow et al.
6,607,437 B2 8/2003 Casey et al.
6,609,971 B2 8/2003 Vancura
6,648,754 B2 11/2003 Baerlocher et al.
6,682,421 B1 1/2004 Rowe et al.
6,688,977 B1 2/2004 Baerlocher et al.
6,692,355 B2 2/2004 Baerlocher et al.
6,692,356 B2 2/2004 Baerlocher et al.
6,749,504 B2 6/2004 Hughs-Baird
6,780,107 B2 8/2004 Baerlocher et al.
6,783,457 B2 8/2004 Hughs-Baird et al.
6,796,900 B2 9/2004 Baerlocher et al.
6,796,904 B2 9/2004 Yoseloff
6,808,452 B2 10/2004 Baerlocher et al.
6,866,586 B2 3/2005 Oberberger et al.
6,875,108 B1 4/2005 Hughs-Baird
6,877,745 B1 4/2005 Walker et al.
6,905,411 B2 6/2005 Nguyen et al.
6,929,545 B2 8/2005 Vancura
6,932,701 B2 8/2005 Glavich et al.
6,958,013 B2 10/2005 Miereau et al.
6,960,132 B2 11/2005 Baerlocher et al.
6,971,954 B2 12/2005 Randall et al.
6,971,956 B2 12/2005 Rowe et al.
6,996,833 B1 2/2006 Olson et al.
7,004,834 B2 2/2006 Walker et al.
7,037,191 B2 5/2006 Rodgers et al.
7,040,984 B2 5/2006 Mead
7,063,617 B2 6/2006 Brosnan et al.
7,112,137 B2 9/2006 Baerlocher et al.
7,118,478 B2 10/2006 Fayter et al.
7,121,942 B2 10/2006 Baerlocher
7,121,943 B2 10/2006 Webb et al.
7,156,738 B2 1/2007 Rowe
7,172,506 B2 2/2007 Baerlocher et al.
7,182,689 B2 2/2007 Hughs-Baird et al.
7,235,011 B2 6/2007 Randall et al.
7,264,545 B2 9/2007 Maya et al.
7,273,415 B2 9/2007 Cregan et al.
7,300,348 B2 11/2007 Kaminkow et al.
7,303,469 B2 12/2007 Kaminkow
7,314,409 B2 1/2008 Maya et al.
7,316,609 B2 1/2008 Dunn et al.
7,326,110 B2 2/2008 Webb et al.
7,331,863 B2 2/2008 Baerlocher
7,338,367 B2 3/2008 Kaminkow et al.
7,371,174 B2 5/2008 Baerlocher
7,381,134 B2 6/2008 Cuddy et al.
7,413,510 B2 8/2008 Schlegel et al.
7,488,248 B2 2/2009 Hughs-Baird et al.
7,544,129 B2 6/2009 Baerlocher
7,566,271 B2 7/2009 Hostetler et al.
7,585,218 B2 9/2009 Mead et al.
7,591,722 B2 9/2009 Baerlocher et al.
7,597,620 B2 10/2009 Webb et al.
7,601,058 B2 10/2009 Slomiany
7,690,981 B2 4/2010 Ching et al.
7,708,630 B2 5/2010 Nicely
7,726,655 B2 6/2010 Walker et al.
7,749,070 B2 7/2010 Baerlocher et al.
7,785,188 B2 8/2010 Cannon
7,806,760 B2 10/2010 Baerlocher
7,833,095 B2 11/2010 Cuddy et al.
7,837,554 B2 11/2010 Kaminkow et al.
7,867,074 B2 1/2011 Gerrard et al.
7,874,912 B2 1/2011 Cregan et al.
7,887,409 B2 2/2011 Baerlocher et al.

(56) References Cited

U.S. PATENT DOCUMENTS

| | | | |
|---|---|---|---|
| 7,942,737 | B2 | 5/2011 | Cregan et al. |
| 7,976,382 | B2 | 7/2011 | Benbrahim |
| 8,029,355 | B2 | 10/2011 | Parente |
| 8,029,358 | B2 | 10/2011 | Bigelow, Jr. et al. |
| 8,043,153 | B2 | 10/2011 | Ross et al. |
| 8,079,903 | B2 | 12/2011 | Nicely et al. |
| 8,118,662 | B2 | 2/2012 | Caputo et al. |
| 8,133,105 | B2 | 3/2012 | Walker et al. |
| 8,177,620 | B2 | 5/2012 | Miles et al. |
| 8,210,937 | B2 | 7/2012 | Cregan et al. |
| 8,221,206 | B2 | 7/2012 | Marks et al. |
| 8,262,455 | B2 | 9/2012 | Caputo et al. |
| 8,272,940 | B2 | 9/2012 | Cuddy et al. |
| 8,277,305 | B2 | 10/2012 | Caputo et al. |
| 8,287,364 | B2 | 10/2012 | Caputo et al. |
| 8,360,848 | B2 | 1/2013 | Oles et al. |
| 8,419,518 | B2 | 4/2013 | Jarvis et al. |
| 8,419,525 | B2 | 4/2013 | Caputo et al. |
| 8,460,090 | B1 | 6/2013 | Gilliland |
| 8,460,094 | B2 | 6/2013 | Bigelow, Jr. et al. |
| 2002/0045475 | A1 | 4/2002 | Glavich et al. |
| 2002/0077178 | A1 | 6/2002 | Oberberger et al. |
| 2002/0098888 | A1 | 7/2002 | Rowe et al. |
| 2002/0107065 | A1 | 8/2002 | Rowe |
| 2003/0060254 | A1 | 3/2003 | Cuddy et al. |
| 2003/0083126 | A1 | 5/2003 | Paulsen |
| 2003/0162588 | A1 | 8/2003 | Brosnan et al. |
| 2003/0162591 | A1 | 8/2003 | Nguyen et al. |
| 2003/0171145 | A1 | 9/2003 | Rowe |
| 2005/0020354 | A1 | 1/2005 | Nguyen et al. |
| 2005/0170876 | A1 | 8/2005 | Masci et al. |
| 2005/0215316 | A1 | 9/2005 | Rowe et al. |
| 2006/0247028 | A1 | 11/2006 | Brosnan et al. |
| 2007/0060274 | A1 | 3/2007 | Rowe et al. |
| 2007/0087840 | A1 | 4/2007 | Fayter et al. |
| 2007/0135203 | A1 | 6/2007 | Nicely |
| 2010/0227665 | A1 | 9/2010 | Nicely |
| 2012/0129589 | A1 | 5/2012 | Caputo et al. |
| 2012/0264507 | A1 | 10/2012 | Cregan et al. |
| 2013/0072282 | A1 | 3/2013 | Nicely |
| 2013/0225268 | A1 | 8/2013 | Caputo et al. |

FOREIGN PATENT DOCUMENTS

| | | |
|---|---|---|
| EP | 0926645 | 6/1999 |
| EP | 0945837 | 9/1999 |
| EP | 0984409 | 3/2000 |
| GB | 2144644 | 8/1983 |
| GB | 2333880 | 7/1998 |
| WO | WO 97/32285 | 9/1997 |

GAMING SYSTEM AND METHOD FOR PROVIDING A MULTIPLE LEVEL SELECTION GAME

PRIORITY CLAIM

This application claims priority to and the benefit of U.S. Provisional Patent Application No. 62/056,735, filed on Sep. 29, 2014, the entire contents of which are incorporated herein by reference.

COPYRIGHT NOTICE

A portion of the disclosure of this patent document contains or may contain material which is subject to copyright protection. The copyright owner has no objection to the photocopy reproduction by anyone of the patent document or the patent disclosure in exactly the form it appears in the Patent and Trademark Office patent file or records, but otherwise reserves all copyright rights whatsoever.

BACKGROUND

Gaming machines which provide players awards in primary or base games are well known. Gaming machines generally require the player to place or make a wager to activate the primary or base game. In many of these gaming machines, the award is based on the player obtaining a winning symbol or symbol combination and on the amount of the wager (e.g., the higher the wager, the higher the award). Generally, symbols or symbol combinations which are less likely to occur usually provide higher awards. In such known gaming machines, the amount of the wager made on the base game by the player may vary. That is, different players play at substantially different wagering amounts or levels and at substantially different rates of play.

Secondary or bonus games are also known in gaming machines. The secondary or bonus games usually provide an additional award to the player. Secondary or bonus games usually do not require an additional wager by the player to be activated. Secondary or bonus games are generally activated or triggered upon an occurrence of a designated triggering symbol or triggering symbol combination in the primary or base game. For instance, a bonus symbol occurring on the payline on the third reel of a three reel slot machine may trigger the secondary bonus game. When a secondary or bonus game is triggered, the gaming machines generally indicates this to the player through one or more visual and/or audio output devices, such as the reels, lights, speakers, video screens, etc. Part of the enjoyment and excitement of playing certain gaming machines is the occurrence or triggering of the secondary or bonus game (even before the player knows how much the bonus award will be).

Certain known gaming machines employ a variety of different selection type games as bonus games. Upon an initiation of certain of these known selection type bonus games, the gaming machine displays a plurality of selections and enables a player to pick one of the displayed selections. If the picked selection is associated with an award, the gaming machine provides the player that award. In certain selection games, the gaming machine provides the player with a limited quantity of picks (such as five picks), and enables the player to use each pick to select one of the displayed selections.

There is a continuing need to provide new, exciting, and engaging bonus games and, in particular, new, exciting, and engaging variations of selection type bonus games, to increase player enjoyment and excitement.

SUMMARY

The present disclosure relates generally to gaming systems and methods for providing a multiple level selection game.

In various embodiments, the gaming system disclosed herein displays a play of a multiple level selection game. Each level includes a quantity of selections. For each level, one, more or each of the selections are each associated with one of a plurality of different awards. In these embodiments, for each level, the gaming system enables a player to pick a quantity of the selections. Prior to revealing any awards associated with each player pick, the gaming system also enables the player to designate one or more of the player picked selections as designated selections or designated picks. In conjunction with enabling the player to designate one or more picked selections as designated selections, the gaming system determines one or more modifiers and applies such determined modifiers to any awards associated with the designated selections. The gaming system then reveals the awards associated with the player picked selections (including the modified awards associated with the one or more player designated selections). In certain embodiments, if the total value of the revealed awards for a currently played level is at least equal to a threshold value associated with the currently played level, the gaming system proceeds to the next level, if any, of the multiple level selection game.

More specifically, in operation of various embodiments, upon an occurrence of a selection game triggering event, the gaming system triggers a play of the multiple level selection game. In certain embodiments, the gaming system causes a selection game triggering event to occur based on (or as a result of) one or more displayed events occurring in association with one or more plays of one or more games. In another embodiment, the gaming system causes a selection game triggering event to occur independent of any displayed events associated with any plays of any games.

After the gaming system triggers the multiple level selection game, the gaming system displays the play of a level of the multiple level selection game. For the play of the level of the multiple level selection game, the gaming system displays a plurality of selectable selections. Each selection is associated with one of a plurality of different awards which are initially hidden from the player. The gaming system enables a player to pick at least two selections from the plurality of selections displayed for the current level of the multiple level selection game. Following the player picking at least two of the displayed selections and prior to displaying any awards associated with any player picked selections, the gaming system enables the player to designate at least one of the player selected selections. Such a configuration of enabling a player to pick a first set of a plurality of selections and then enabling the player to further pick a subset of this first set of selections provides an increased level of interaction with the player and enhances the gaming experience for certain players.

For each designated selection, the gaming system determines one or more modifiers and applies the determined modifiers to any awards associated with such designated selections. Following the application of one or more modifiers to one or more selections twice picked by the player (i.e., the initial picking of the selection and the subsequent picking of that selection as a designated selection), the gaming system reveals the awards associated with each of the selections picked by the player. Such revealed awards include any awards associated with any non-designated player picked selections and any modified awards associated with any designated player picked selections. After revealing the awards/modified awards associated with the player picked selections, the gaming system determines and displays a total award.

Following the display of the total award, the gaming system utilizes this displayed total award to determine whether or not to proceed to another level, if any, of the multiple level selection game. Specifically, in certain embodiments, the gaming system determines if the determined total award equals or exceeds a threshold value, if any, for the current level of the multiple level selection game. If the gaming system determines that the total award equals or exceeds a threshold value for the current level of the multiple level selection game, the gaming system proceeds to a subsequent level of the multiple level selection. On the other hand, if the gaming system determines that the total award does not equal or exceed a threshold value for the current level (or if the current level is a final level not having any threshold value), the gaming system terminates the play of the multiple level selection game Accordingly, the selection game disclosed herein provides a first player decision regarding which selections to pick and a second player decision regarding which picked selections to apply one or more modifiers to maximize their awards. As such, providing a multiple level selection game wherein a player's decision to pick one or more awards to which a modifier is applied increases the level of excitement and enjoyment for certain players as these players enjoy the anticipation and volatility involved in maximizing any awards for the play of the multiple level selection game.

Additional features and advantages are described herein, and will be apparent from the following Detailed Description and the figures.

DETAILED DESCRIPTION

Multiple Level Selection Game

In various embodiments, the gaming system disclosed herein displays a play of a multiple level selection game. Each level includes a quantity of selections. For each level, one, more or each of the selections are each associated with one of a plurality of different awards. In these embodiments, for each level, the gaming system enables a player to pick a quantity of the selections. Prior to revealing any awards associated with each player pick, the gaming system also enables the player to designate one or more of the player picked selections as designated selections or designated picks. In conjunction with enabling the player to designate one or more picked selections as designated selections, the gaming system determines one or more modifiers and applies such determined modifiers to any awards associated with the designated selections. The gaming system then reveals the awards associated with the player picked selections (including the modified awards associated with the one or more player designated selections). In certain embodiments, if the total value of the revealed awards for a currently played level is at least equal to a threshold value associated with the currently played level, the gaming system proceeds to the next level, if any, of the multiple level selection game. Such a configuration thus provides that a player's decision regarding which selection to pick as a designated selection provides an increased level of excitement and anticipation for certain players.

While certain of the embodiments described below are directed to selecting awards in a secondary game, it should be appreciated that the present disclosure may additionally or alternatively be employed in association with selecting awards in a play of a base game or primary game. Moreover, while the player's credit balance, the player's wager, and any awards are displayed as an amount of monetary credits or currency in the embodiments described below, one or more of such player's credit balance, such player's wager, and any awards provided to such player may be for non-monetary credits, promotional credits, and/or player tracking points or credits.

Figure 1:
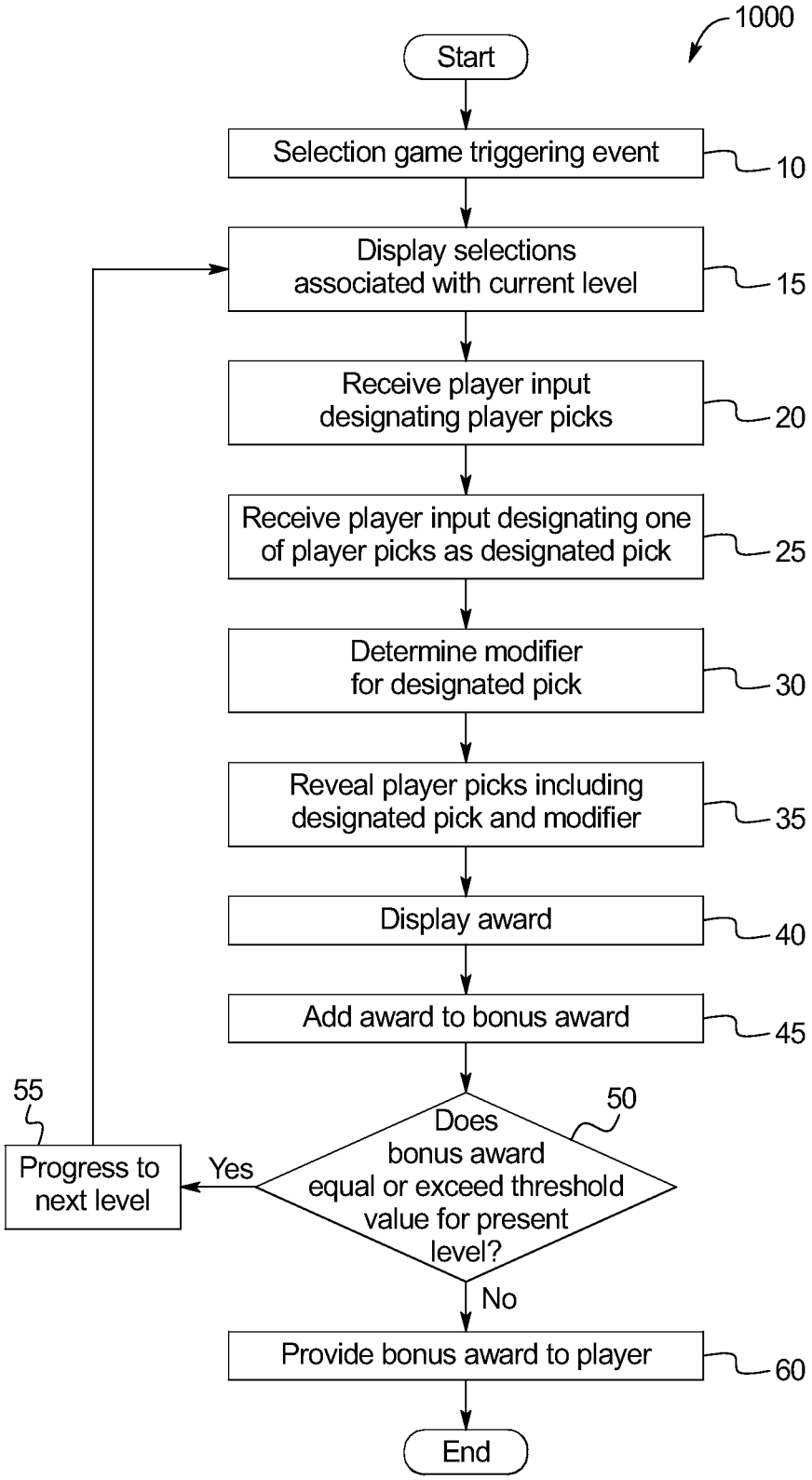
FIG. 1 is a flow chart of an example process for operating a gaming system including a multiple level selection game as disclosed herein.

Referring now to FIG. 1, a flowchart, which illustrates an example process for operating a gaming system disclosed herein. In one embodiment, this process is embodied in one or more software programs stored in one or more memories and executed by one or more processors or servers. Although this process is described with reference to the flowchart illustrated in FIG. 1, it should be appreciated that many other methods of performing the acts associated with this process may be used. For example, the order of certain steps described may be changed, or certain steps described may be optional.

In this embodiment, the example is for a single player game. In this embodiment, as indicated in block 10, the gaming system causes an occurrence of a selection game triggering event.

In one embodiment, the gaming system causes a selection game triggering event to occur independent of any displayed events associated with any plays of any games. In another embodiment, the gaming system causes a selection game triggering event to occur based on (or as a result of) one or more displayed events occurring in association with one or more plays of one or more games. In another embodiment, the gaming system tracks the occurrences of one or more suitable events occurring at or in association with one or more players and/or one or more games and determines, based on these tracked events, whether a selection game triggering event occurs. In another embodiment, the gaming system defines one or more game play parameters, such as a wager amount or a maximum wager amount, wherein the gaming system determines whether a selection game triggering event occurs based on a player's tracked game play activity satisfying the defined parameter. In one embodiment, the selection game triggering event is the occurrence of a combination of symbols when a wager of a designated amount is placed.

Upon the occurrence of the selection game triggering event, the gaming system initiates a play of a level of the multiple level selection game and displays a plurality of selections associated with that level, as indicated by block 15. Each selection is associated with an award or award value. In various embodiments, the award values are selected from a set of award values, wherein each set of award values is unique to the currently displayed level. For example, for the play of a first level of the multiple level selection game, the award values associated with the selections are selected from a set of award values that are specific to the first level and for the play of a second, different level of the multiple level selection game, the award values associated with the selections are selected from a different set of award values that are specific to the second level. In certain alternative embodiments, zero, one or more of the award values associated with the selections in one level are the same as zero, one or more of the award values associated with the selections in another level.

In one embodiment, the award value associated each of the displayed selections is a quantity of credits. In different alternative embodiments, the award value may include a quantity of free spins, a modifier, a quantity of points, a quantity of non-monetary credits and/or a progressive award, in addition to or instead of a quantity of credits.

For the play of each level, a player is provided a plurality of player picks. For each of the player picks, the gaming system receives at least one player input indicative of a pick of one of the plurality of displayed selections as indicated by block 20. In various embodiments, for each level, the quantity of player picks may be predetermined, randomly determined, be the same as that of another level, vary based on one or more factors such as wager amount, outcome of a previous level and/or a bonus triggering event. In various embodiments, the gaming system may pick the displayed selections as the player picks, based on a random determination, based on predetermined choices set by a player, based on a predetermined pattern, or otherwise.

The gaming system also provides a quantity of designated picks for each level of the multiple level selection game. The quantity of designated picks is at least one but lesser than or equal to the quantity of player picks. For each of the quantity of designated picks, the gaming system receives a player input indicative of one designated pick from the plurality of player picked selections. In other words, as indicated by block 25, the gaming system receives a player input designating one or more of the player picks as designated picks. In various embodiments, the gaming system may pick the designated picks, based on a random determination, based on predetermined choices set by a player, based on a predetermined pattern, or otherwise.

In addition to receiving one or more player input indicative of the designated picks, the gaming system determines one or more modifiers to apply to each of the designated picks, as indicated by block 30. In other words, for each designated pick, the gaming system determines a modifier from a group of modifiers that the gaming system will apply to the designated pick. In certain embodiments, one modifier applies to all designated picks. In certain other embodiments, each designated pick has one modifier that is selected from a group of modifiers. The selection process may enable the same modifier to be applied to more than one designated pick, or may only enable for each designated pick to have a unique modifier.

Following the player picking a plurality of the displayed selections and then further designating one or more of these picked selections, the gaming system reveals the awards associated with the player picks, including the designated picks, as indicated by block 35. The gaming system also reveals the one or more modifiers to be applied to the designated picks. After the awards are displayed, the gaming system modifies the awards associated with the designated picks based on their respective modifiers. The gaming system then determines the award for the play of that level by adding the awards associated with the player picks, including the modified awards associated with the designated picks. The gaming system displays the determined award for that level, as indicated by block 40.

Further, the award for the level is added to award from any previous levels, as indicated by block 45. If the play of the multiple level selection game is for a first level, then the award from any previous levels will be zero. However, if the play of the multiple level game for any level other than the first level, then the award from any previous levels will be the sum of the awards from all the previous levels. In certain alternative embodiments, the gaming system does not keep a running total of awards from previous levels, but rather provides the value of the award after each level to the player, and resets its value to zero prior to the start of a next level.

The gaming system determines if a value of the award at least meets the threshold value to qualify to play the next level of the multiple level selection game, as indicated by block 50 in FIG. 1.

If the determined value of the award for the current level meets the threshold value to qualify to play the next level, the play of the multiple level game proceeds to the next level, as indicated by block 55. For the play of the next level, the gaming system returns to block 15 and proceeds with displaying another plurality of selections associated with this next level of the multiple level selection game.

On the other hand, if the determined value of the award for the current level does not meet the threshold value to qualify to play the next level, the play of the multiple level selection game terminates and the gaming system provides the award value to the player, as indicated by block 60. Further, in various embodiments, the play of the multiple level selection game also terminates when there are no more levels to play in the multiple level selection game. That is, when the play of the last level has been completed, then regardless of the total award value, the play of the multiple level selection game terminates and the gaming system provides the total award value to the player.

Figure 2A:
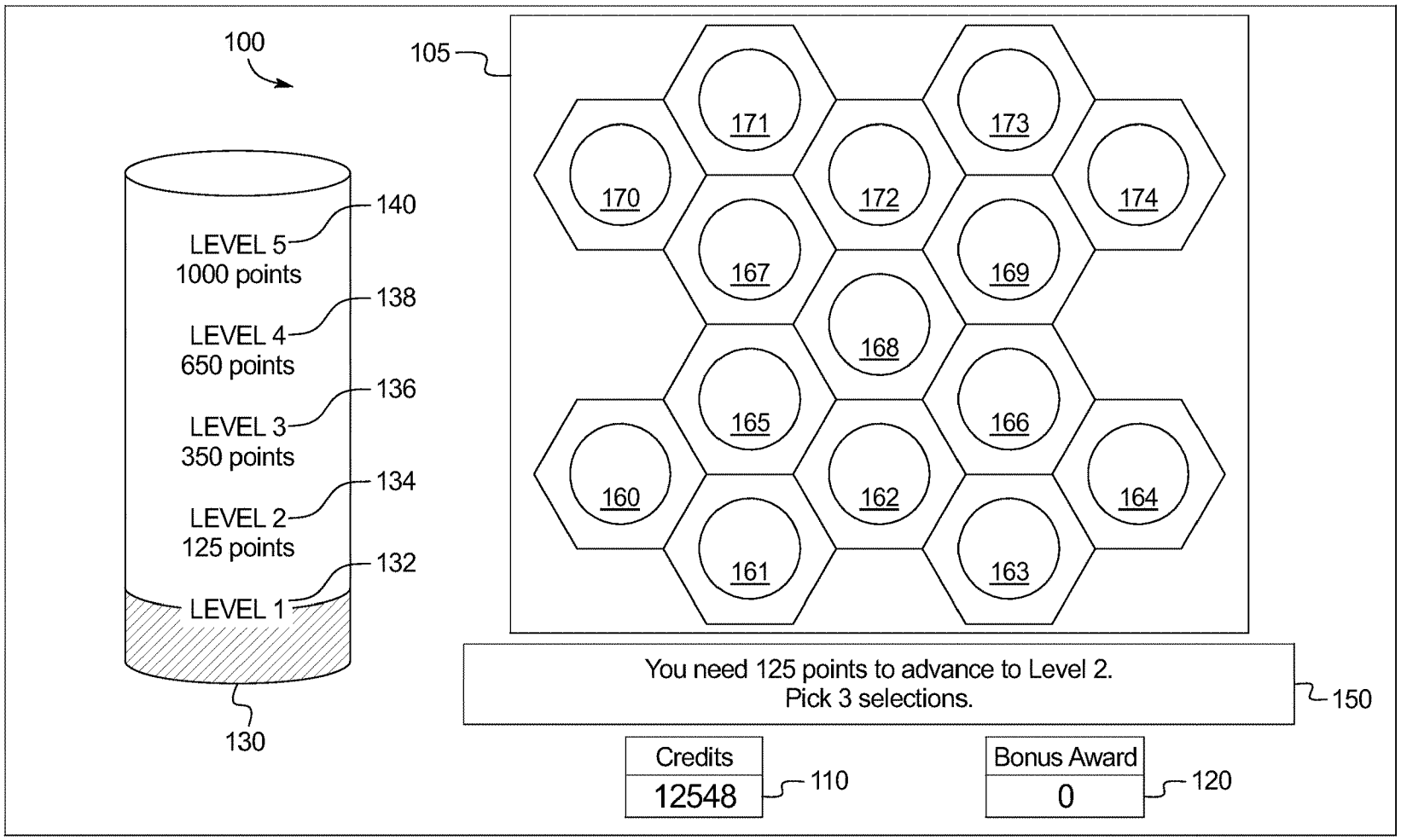
FIGS. 2A, 2B, 2C, 2D, and 2E are screen shots of one embodiment of the gaming system disclosed herein illustrating a multiple level selection game.

FIGS. 2A, 2B, 2C, 2D, and 2E are screen shots of one embodiment of the gaming system disclosed herein illustrating a first level of the multiple level selection game. For example, as seen in FIG. 2A, the gaming system displays a plurality of selections 161, 162, 163, 164, 165, 166, 167, 168, 169, 170, 171, 172, 173, and 174 at a plurality of positions within selection area 105. Each selection is associated with an award value. In various embodiments, the award values are initially hidden, as shown in FIG. 2A.

The gaming system also displays a credit meter 110 and a bonus award meter 120. Credit meter 110 displays the credit balance that is available at the gaming system. The bonus award meter 120 displays the total credits won in the play of the multiple level selection game. The gaming system also displays a level meter 130 which indicates the current level being played in the multiple level selection game. Additionally, level meter 130 displays the various levels available to play and a threshold bonus award value needed to progress to each level. In this example, the level meter 130 indicates five different levels, such as Level 1 (132), Level 2 (134), Level 3 (136), Level 4 (138), and Level 5 (140). FIG. 2A depicts that Level 1 (132) is the current level being played of the five levels available in the play of the multiple level selection game by indicating level meter 130 filed only up to Level 1 (132). The gaming system also displays message display area 150 that shows pertinent information to the player. In various embodiments, the threshold bonus award value needed for each level is predetermined, randomly determined, vary based on one or more factors such as wager amount, bonus triggering event, determined based on bonus awards accumulated and/or achieved in previous levels.

In this example, the gaming system provides the player three player picks for Level 1. The gaming system displays a prompt to the player, such as "YOU NEED 125 POINTS TO ADVANCE TO LEVEL 2. PICK 3 SELECTIONS" as displayed in message display area 150. The gaming system uses a touch screen input device to receive player input. In various embodiments, other input devices such as a mouse, keyboard, or buttons corresponding to selection displayed by the gaming system may be used to receive player input.

Figure 2B:
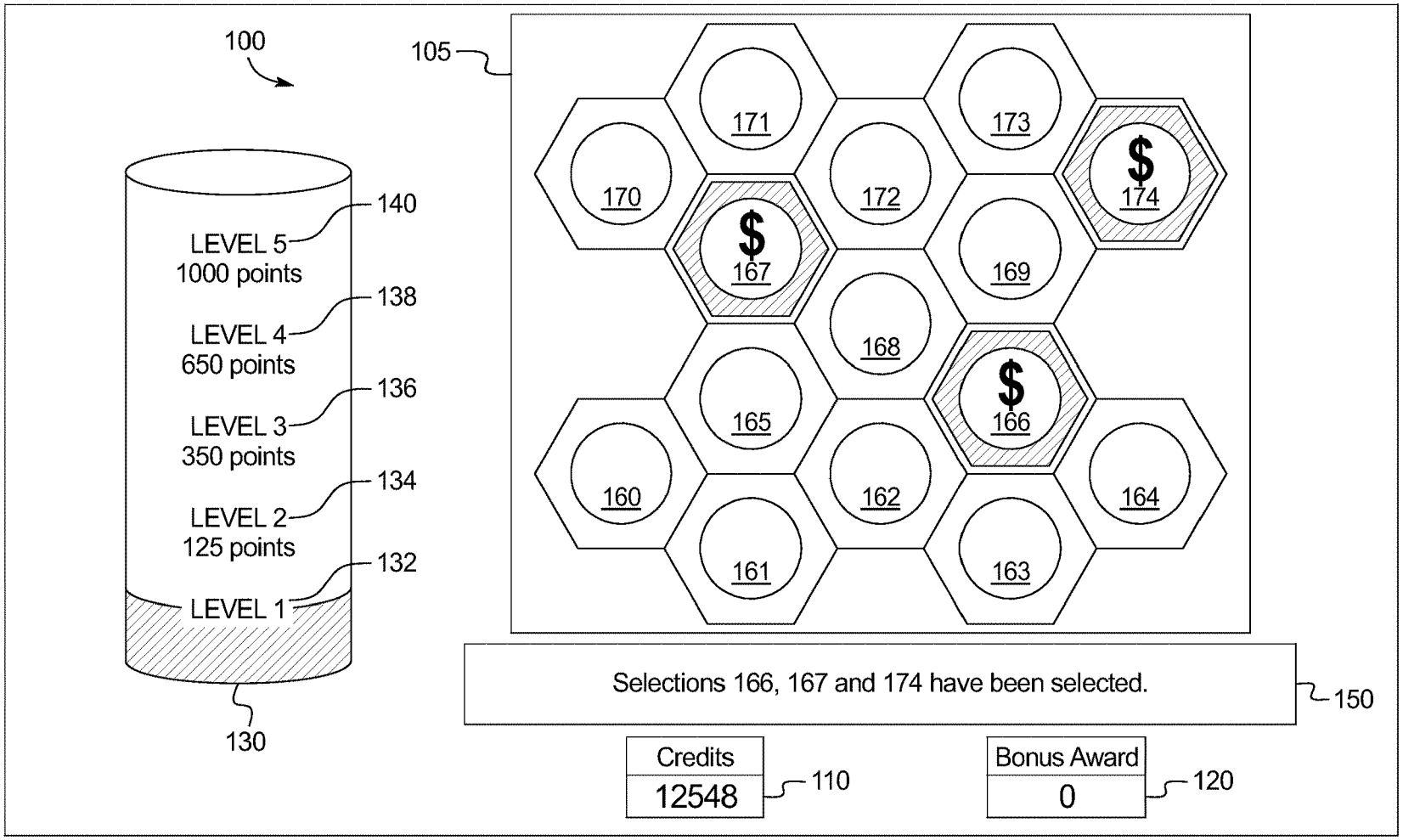

In this example, the gaming system receives player selections 166, 167, and 174 as the three player picks, as shown in FIG. 2B. The gaming system displays a message to the player, such as "SELECTIONS 166, 167, AND 174 HAVE BEEN SELECTED" in message display area 150. The gaming system also indicates the three player picks by way of a special symbol or indication on selections 166, 167, and 174.

Figure 2C:
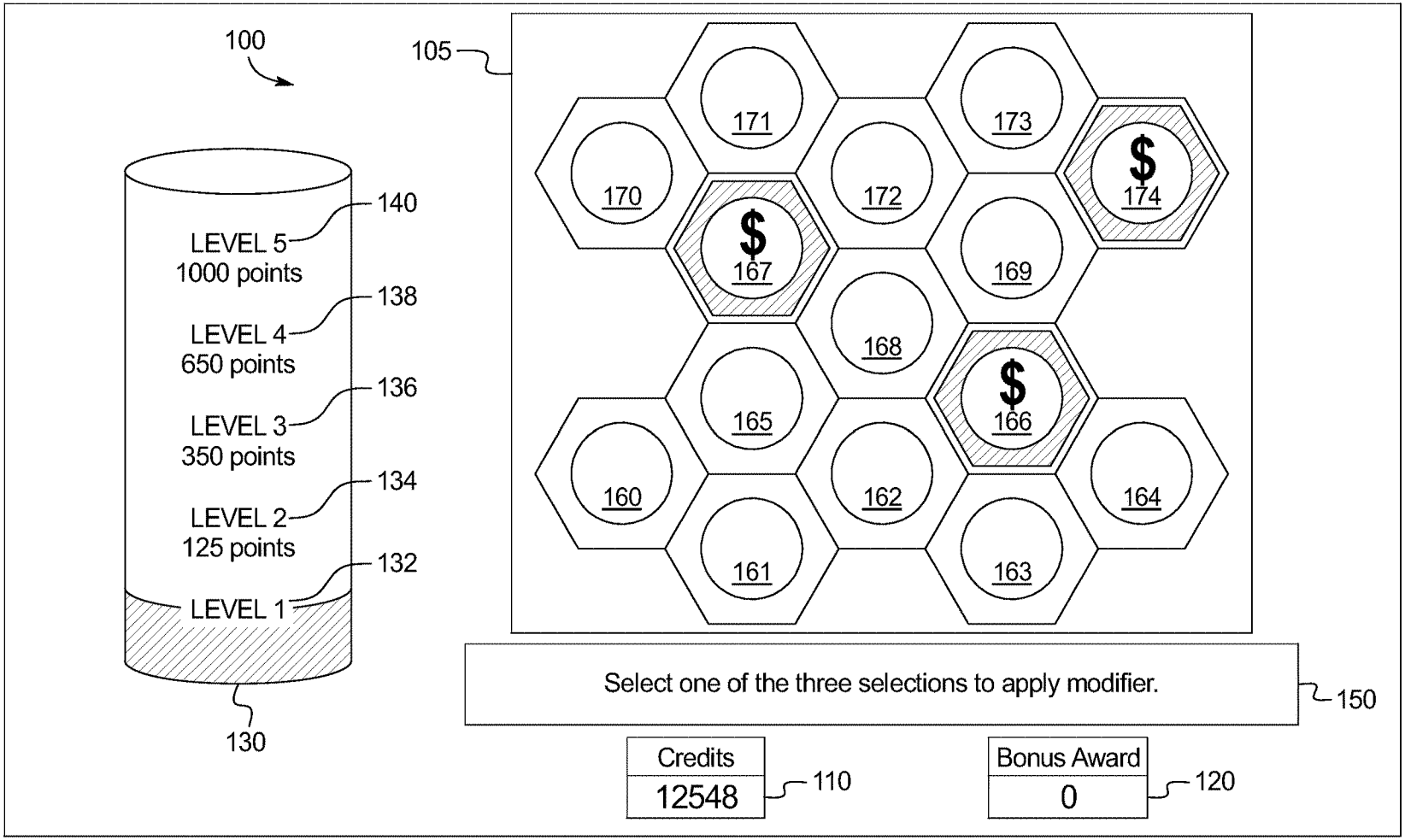

In this example, the gaming system provides one designated pick for the play of Level 1 of the multiple level selection game. The gaming system prompts the player to provide player input designating one of the three player picks 166, 167, and 174 as a designated selection, such as by showing message "SELECT ONE OF THE THREE SELECTIONS TO APPLY MODIFIER" in message display area 150, as shown in FIG. 2C. In this example, the gaming system is configured to designate one of the player picks as a designated pick for the play of the first level of the multiple level selection game. In alternative embodiments, for each level, the quantity of designated picks are predetermined, randomly determined, vary based on level being played, based on a wager amount, depend on the quantity of player picks, vary from zero to a maximum value, vary from a minimum value to a quantity equal to the quantity of player picks, and based on the triggering event.

Figure 2D:
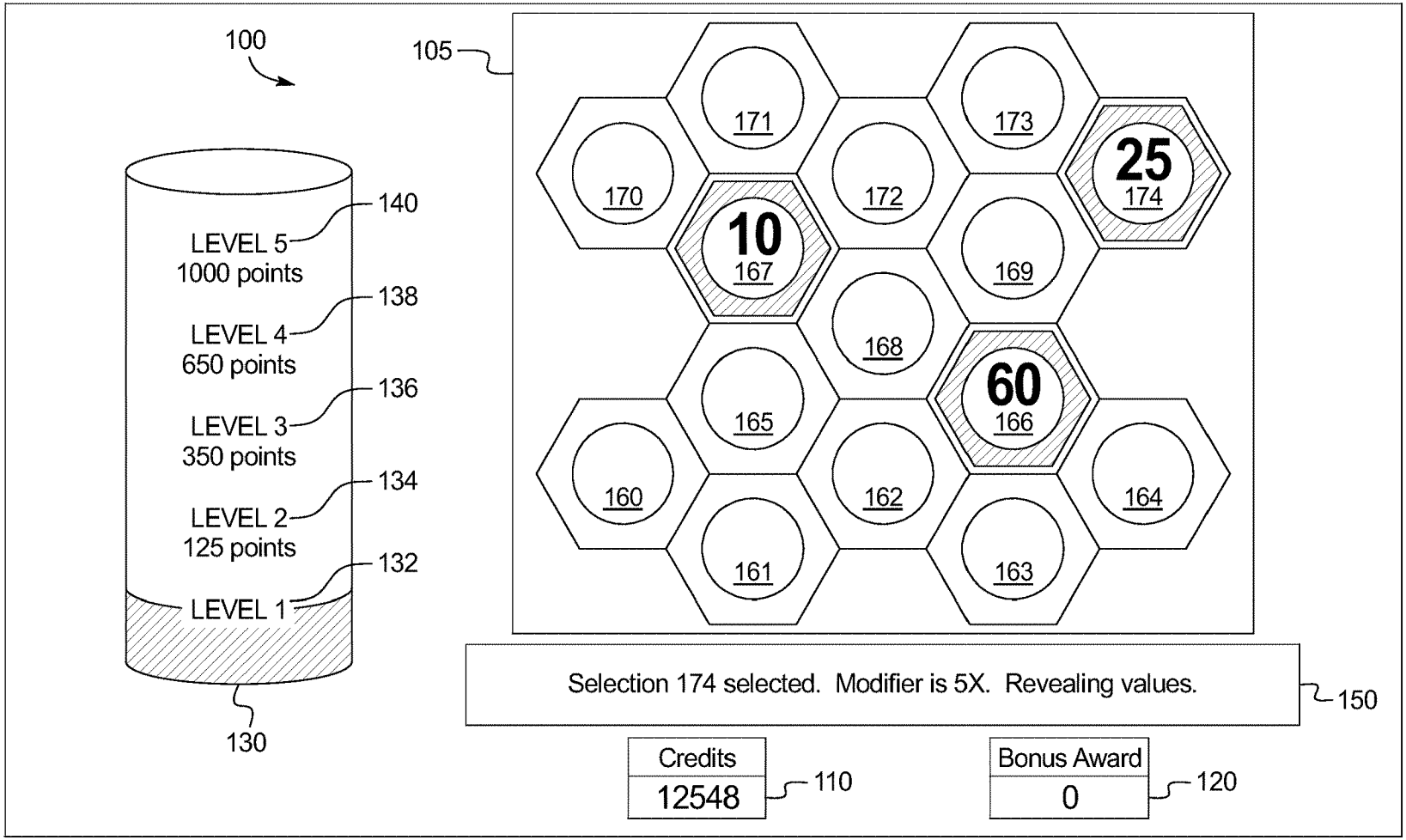

In this example, the gaming system receives player input from a touch screen input device indicative of selection 174 as the designated pick. After the gaming system receives player input indicative of the designated pick, from one of the player picks, the gaming system determines a modifier to apply to the designated pick. As shown in FIG. 2D, the gaming system displays a message "SELECTION 174 SELECTED. MODIFIER IS 5×. REVEALING VALUES" in message display area 150. In this example, gaming system determined that a 5× multiplier will be the modifier that will be applied to the designated pick 174. However, the modifier value is not displayed until after the designated pick is received by the gaming system. In certain alternative embodiments, the gaming system determines and displays the modifier value prior to the receiving player input indicative of the designated pick.

Figure 2E:
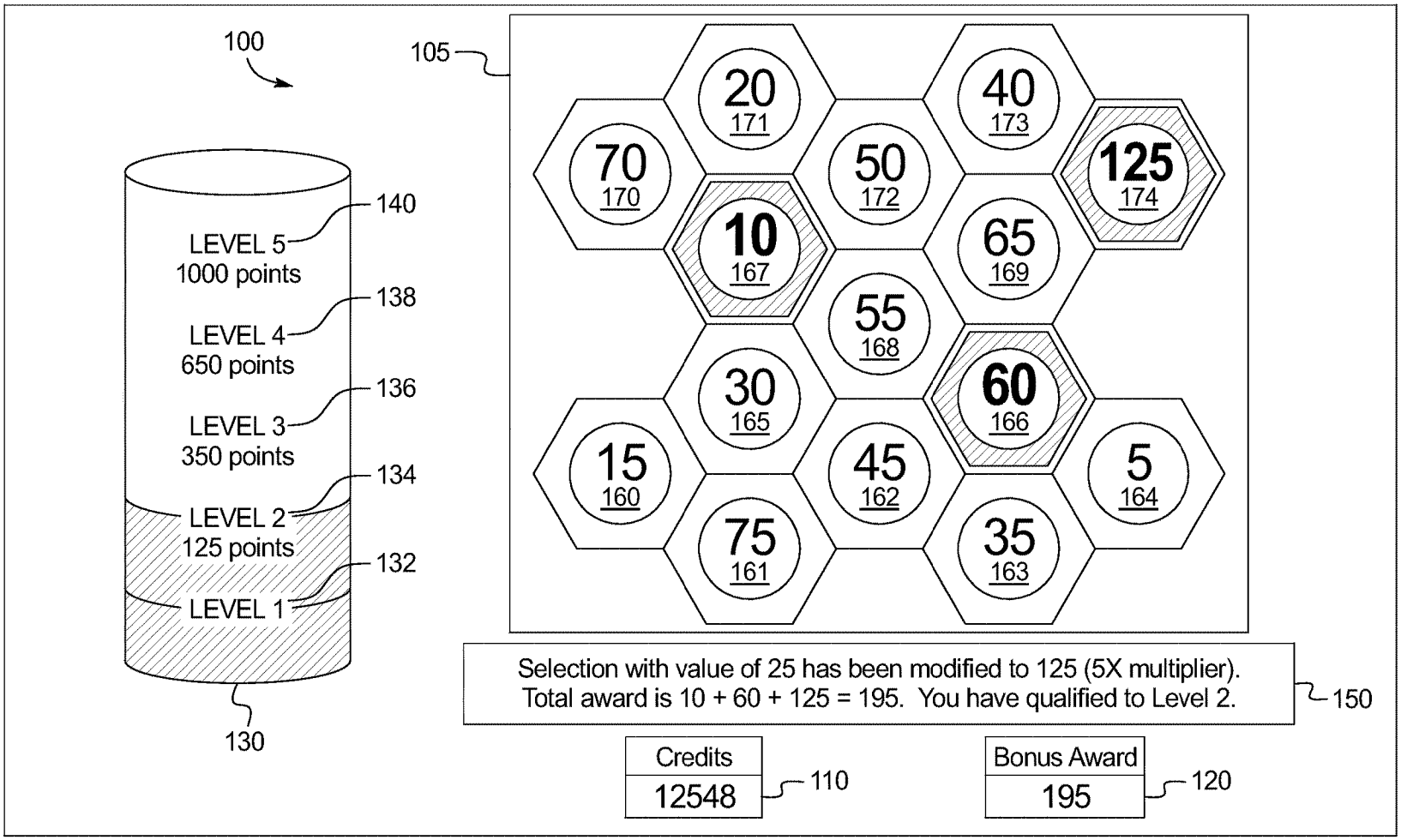

The gaming system then reveals the awards associated with the player picks. As seen in FIG. 2E, the player pick 166 has an award value of 60, the player pick 167 has an award value of 10 and player pick 174 has an award value of 125 (the award value of 25 is modified to 125 due to the 5× multiplier), for a level 1 bonus award of 195. Bonus award meter 120, as shown in FIG. 2E, is updated to reflect the new total. Here, bonus award meter 120 is updated to reflect a new value of 195, since the bonus award at the start of level 1 was 0. In this example, the threshold value of Level 2 is 125, as indicated by indicator 134 in FIG. 2E. The value of bonus award meter 120 in the play of level 1 is 195 which exceeds this threshold value for level 1.

The gaming system may also display a suitable message such as "SELECTION WITH VALUE OF 25 HAS BEEN MODIFIED TO 125 (5× MULTIPLIER). TOTAL AWARD IS 60+70+125=255. YOU HAVE QUALIFIED FOR LEVEL 2" as shown in message display area 150. The gaming system also updates level meter 130 to indicate that the play of the bonus game is progressing to level 2 by filling level meter 130 up to Level 2 (134). The gaming system then commences play of Level 2 of the multiple level selection game by displaying a quantity of selections to the player, as indicated by block 15 of FIG. 1.

In various embodiments, when the play of the current level of the multiple level selection game has ended and the bonus award value is lesser than the threshold value needed to progress to the next level, the play of the bonus game ends and the player is awarded the current accumulated value of bonus award meter 120. Additionally, if the current level is the last level of play in the multiple level selection game, the play of the bonus game ends. For example, as seen in FIG. 2E, Level 5 (140) is the last level in the level meter 130. If, for the play of the multiple level selection game, the current level of play is Level 5, then after the completion of play of Level 5 of the multiple level selection game, the play of the multiple level selection game ends and the gaming system awards the value of the bonus award meter 120.

It should be appreciated that bonus award meter 120 accumulates bonus award from each level of the multiple level bonus game. In other words, after each level, the award value is added to the current value of bonus award meter 120. In various embodiments, after each level, bonus award meter 120 is reset to a predetermined value, such as zero, prior to play of the next level.

In certain embodiments, the last level in level meter 130 may be associated with a progressive prize or a jackpot prize. For example, the gaming system may provide a Level 6 in level meter 130. If after play of Level 5, the accumulated value of bonus award meter 120 meets or exceeds the threshold value of Level 6, then the gaming systems awards a progressive prize or a jackpot prize. In certain of these embodiments, each level or some of the levels may be associated with progressive prizes.

In various embodiments, the gaming system also reveals the awards associated with the selections not picked by the player, as shown in FIG. 2E. For example, the gaming system displays the awards associated with selections 161, 162, 163, 164, 165, 168, 169, 170, 171, 172, and 173.

In various embodiments, the selections are associated with both modifiers and award values. The gaming system does not reveal the modifiers associated with the selections that are selected as player picks, but does reveal the modifiers associated with the selections that are selected as the designated picks.

In various embodiments, the designated picks are not selected from the plurality of player picks. Rather, the player first chooses a first quantity of player picks and a second quantity of designated player picks. The award values associated with the second quantity of designated player picks are modified based on modifiers determined by the gaming system.

In various embodiments, the quantity of player picks is the same for two or more levels of the multiple level selection game. In various other embodiments, the quantity of player picks is the same for all levels of the multiple level selection game. In various embodiments, the quantity of designated picks is the same for two or more levels of the multiple level selection game. In various embodiments, the quantity of designated picks is the same for all levels of the multiple level selection game.

In various embodiments, the play of the multiple level selection game proceeds to the next level only if the bonus award value exceeds the threshold value for that level. In various embodiments, the play of the multiple level selection game proceeds to the next level if the bonus award value is at least equal to the threshold value for that level.

In various embodiments, at any time during the play of the selection game, if a selection game termination event occurs, the gaming system terminates the play of the game. In one such embodiment, the selection game termination event randomly occurs. In certain alternative embodiments, the selection game termination event occurs after a predetermined duration, such as a period of time, after a quantity of awards that have been selected, or after a quantity of levels. In other embodiments, the selection game termination event is based on a predetermined quantity of selections made by the player. In another embodiment, the selection game termination event is based on the player selecting a designated award or a quantity of designated awards.

In another alternative embodiment, the gaming system provides the player a quantity of credits at the start of the selection game. In one such embodiment, the gaming system enables the player to use the provided credits to purchase each displayed selection, each displayed selection is associated with a purchase credit value, wherein for each purchased selection, the gaming system reduces the total initial provided credits by the purchase credit value associated with the selection. In this embodiment, the selection game termination event occurs when the player uses all of the provided credits.

It should be appreciated that the example embodiment described with respect to FIGS. 1 and 2A to 2E is an individual player embodiment. In another embodiment, the selection game is a community selection game. In this embodiment, each of a plurality of players playing a plurality of electronic gaming machines participate in the play of the selection game by selecting displayed selections of the selection game. In one embodiment, the selection game is a cooperative community game wherein a plurality of players cooperate or play together to select the displayed selections of the selection game. In another embodiment, the selection game is a competition community game wherein a plurality of players compete or play against each other to select more awards or awards associated with higher award values than other players of the selection game.

In one such embodiment, the gaming system provides a different designated zone of availability for each player. For each zone, the gaming system designates any selection that the gaming system displays within that zone as available for the player associated with that zone. In this embodiment, based on the current position of a selection, the gaming system may designate the same selection as available to pick for one player, and unavailable to pick for another player at the same time. That is, the gaming system may display a selection within one player's zone, (i.e., designated zone of availability) and outside of another player's zone (i.e., designated zone of availability), thereby enabling one player to select the selection which another player cannot. It should be appreciated that in this embodiment, the gaming system enables the plurality of players to select from the same pool of selection and thus, this group selection game includes a further aspect of player strategy as one or more players weigh picking an available selection versus not picking the selection and running the risk that another player will pick that selection.

Selection Game Triggering Event

In different embodiments, a selection game triggering event occurs based on an outcome associated with one or more plays of any primary games. In one embodiment, such determinations are symbol driven based on the generation of one or more designated symbols or symbol combinations. In various embodiments, a generation of a designated symbol (or sub-symbol) or a designated set of symbols (or sub-symbols) over one or more plays of a primary game causes such conditions to be satisfied and/or one or more of such events to occur.

In different embodiments, a selection game triggering event occurs based on an outcome associated with a random determination of a bonus game. For example, one or more slices of a wheel are associated with the selection game. A random determination is made and one of the slices of the wheel is selected. If the selected slice is associated with the selection game, the play of the selection game is provided to the player. In certain embodiments, the random determination is not displayed as a wheel spin. In certain of these embodiments, the random determination is displayed as a reel spin, a book flip, or other similar presentations.

In different embodiments, the gaming system does not provide any apparent reasons to the players for an occurrence of a selection game triggering event. In these embodiments, such determinations are not triggered by an event in a primary game or based specifically on any of the plays of any primary games. That is, these events occur without any explanation or alternatively with simple explanations.

In one such embodiment, a selection game triggering event occurs based on an amount of coin-in. In this embodiment, the gaming system determines if an amount of coin-in reaches or exceeds a designated amount of coin-in (i.e., a threshold coin-in amount). Upon the amount of coin-in wagered reaching or exceeding the threshold coin-in amount, the gaming system causes one or more of such events or conditions to occur. In another such embodiment, a selection game triggering event occurs based on an amount of virtual currency-in. In this embodiment, the gaming system determines if an amount of virtual currency-in wagered reaches or exceeds a designated amount of virtual currency-in (i.e., a threshold virtual currency-in amount). Upon the amount of virtual currency-in wagered reaching or exceeding the threshold virtual currency-in amount, the gaming system causes one or more of such events or conditions to occur. In different embodiments, the threshold coin-in amount and/or the threshold virtual currency-in amount is predetermined, randomly determined, determined based on a player's status (such as determined through a player tracking system), determined based on a generated symbol or symbol combination, determined based on a random determination by the central controller, determined based on a random determination at the gaming device, determined based on one or more side wagers placed, determined based on the player's primary game wager, determined based on time (such as the time of day) or determined based on any other suitable method or criteria.

In one such embodiment, a selection game triggering event occurs based on an amount of coin-out. In this embodiment, the gaming system determines if an amount of coin-out reaches or exceeds a designated amount of coin-out (i.e., a threshold coin-out amount). Upon the amount of coin-out reaching or exceeding the threshold coin-out amount, the gaming system causes the selection game triggering event to occur. In another such embodiment, selection game triggering event occurs based on an amount of virtual currency-out. In this embodiment, the gaming system determines if an amount of virtual currency-out reaches or exceeds a designated amount of virtual currency-out (i.e., a threshold virtual currency-out amount). Upon the amount of virtual currency-out reaching or exceeding the threshold virtual currency-out amount, the gaming system causes the selection game triggering event to occur. In different embodiments, the threshold coin-out amount and/or the threshold virtual currency-out amount is predetermined, randomly determined, determined based on a player's status (such as determined through a player tracking system), determined based on a generated symbol or symbol combination, determined based on a random determination by the central controller, determined based on a random determination at the gaming device, determined based on one or more side wagers placed, determined based on the player's primary game wager, determined based on time (such as the time of day) or determined based on any other suitable method or criteria.

In different embodiments, a selection game triggering event occurs based on a predefined variable reaching a defined parameter threshold. For example, when the 500,000$^{th}$ player has played an electronic gaming machine (ascertained from a player tracking system), the selection game triggering event occurs. In different embodiments, the predefined parameter thresholds include a length of time, a length of time after a certain dollar amount is hit, a wager level threshold for a specific device (which electronic gaming machine is the first to contribute $250,000), a number of electronic gaming machines active, or any other parameter that defines a suitable threshold.

In different embodiments, a selection game triggering event occurs based on a quantity of games played. In this embodiment, a quantity of games played is set for when the selection game triggering event will occur. In one embodiment, such a set quantity of games played is based on historic data.

In different embodiments, a selection game triggering event occurs based on time. In this embodiment, a time is set for when one or more of such events or conditions will occur. In one embodiment, such a set time is based on historic data.

In different embodiments, a selection game triggering event occurs based upon gaming system operator defined player eligibility parameters stored on a player tracking system (such as via player tracking card or other suitable manner). In this embodiment, the parameters for eligibility are defined by the gaming system operator based on any suitable criterion. In one embodiment, the gaming system recognizes the player's identification (via the player tracking system) when the player inserts or otherwise associates their player tracking card in the electronic gaming machine. The gaming system determines the player tracking level of the player and if the current player tracking level defined by the gaming system operator is eligible for one or more of such events or conditions. In one embodiment, the gaming system operator defines minimum bet levels required for such events or conditions to occur based on the player's card level.

In different embodiments, a selection game triggering event occurs based on a system determination, including one or more random selections by the central controller. In one embodiment, as described above, the gaming system tracks all active electronic gaming machines and the wagers they placed. In one such embodiment, based on the electronic gaming machine's state as well as one or more wager pools associated with the electronic gaming machine, the gaming system determines whether selection game triggering event will occur. In one such embodiment, the player who consistently places a higher wager is more likely to be associated with an occurrence the selection game triggering event than a player who consistently places a minimum wager. It should be appreciated that the criteria for determining whether a player is in active status or inactive status for determining if one or more of such events occur may the same as, substantially the same as, or different than the criteria for determining whether a player is in active status or inactive status for another one of such events to occur.

In different embodiments, a selection game triggering event occurs based on a determination of if any numbers allotted to an electronic gaming machine match a randomly selected number. In this embodiment, upon or prior to each play of each electronic gaming machine, an electronic gaming machine selects a random number from a range of numbers and during each primary game, the electronic gaming machine allocates the first N numbers in the range, where N is the number of credits bet by the player in that primary game. At the end of the primary game, the randomly selected number is compared with the numbers allocated to the player and if a match occurs, one or more of such events or conditions occur. It should be appreciated that any suitable manner of causing a selection game triggering event to occur may be implemented in accordance with the gaming system and method disclosed herein.

It should be appreciated that one or more of the above-described triggers pertaining to one or more of such triggering events occurring may be combined in one or more different embodiments.

Awards Associated with Selections

In certain embodiments of the present disclosure, the gaming system uses a same set of awards to associate with selections for some or all of the levels for the play of the selection game. In certain alternative embodiments, the gaming system introduces new, different awards throughout the play of the selection game, which vary from one level to another. In one such embodiment, the gaming system removes any unselected awards after a duration. That is, each award is temporarily provided in the selection game. In another such embodiment, the gaming system removes any selected awards for the play of the subsequent levels and replaces the selected awards with other awards for the play of the subsequent levels.

In certain embodiments, the duration that the gaming system uses an award associated with a selection includes a period of time, a quantity of selections, or a quantity of levels completed by the award.

In one embodiment, as the selection game progresses through various levels, the gaming system displays new awards associated with higher award values than at the start of the selection game. In certain alternative embodiments, the gaming system provides selections associated with a higher award value at the start of the selection game and provides awards associated with lower award values as the selection game progresses through various levels. In other alternative embodiments, the gaming system provides a variety of high and low award values throughout the selection game. In various alternative embodiments, the gaming system provides a certain jackpot value after a predetermined quantity of levels of the selection game. Similarly, in certain embodiments, the gaming system provides modifiers associated with higher values as the selection game progresses through various levels. In other embodiments, the gaming system provides modifiers with lower values as the selection game progresses through various levels.

In various embodiments, the gaming system selects the modifier from one of more than one predetermined or randomly determined multiplier values, quantity of free spin games, and bonus credit values.

In certain embodiments, the gaming system displays all of the awards available during the selection game. In certain alternative embodiments, the gaming system displays a subset of the awards. In one embodiment, the gaming system displays the awards within the designated zone of availability. In certain alternative embodiments, the gaming system randomly determines which awards to display such that awards randomly appear and disappear throughout the selection game.

Award Value

In various embodiments of the present disclosure, the gaming system provides various different types of award values associated with each displayed selection. In the example embodiment described above with respect to FIGS. 2A to 2E, each of the displayed selections are associated with a credit value. In certain alternative embodiments, the displayed selections are associated with a quantity of free spins, or a progressive award. In certain alternative embodiments, the gaming system includes a plurality of different types of award values associated with each award for a play of the selection game. In other alternative embodiments, the gaming system enables the player to request a specific type of award value to be associated with the displayed selections. In a different alternative embodiment, the gaming system enables the player to request a type of award if the player selects a designated type of award or a designated quantity of awards within a designated duration.

In certain embodiments, the award value associated with an award impacts other aspects of the game. For example, in one embodiment, if the player selects a designated award, the gaming system delays the selection game termination event. In one such embodiment, the award value associated with a designated award is additional pick for the selection game. In certain alternative embodiments, the gaming system delays the selection game termination event if the player selects a designated quantity of awards or a designated quantity of a designated type of award. That is, in one example, the gaming system provides a bonus duration of the selection game if the player selects a designated award, a designated quantity of awards, and/or a designated total award value, within a predetermined time. In another example, the gaming system speeds up the onset of a selection game termination event based on the selection of a designated award. For example, in one embodiment, if a player selects a designated award, the gaming system reduces the time remaining in the selection game. In another example, the selection of a designated award triggers a selection game termination event.

Alternative Embodiments

In one embodiment, the gaming system causes at least one display device of at least one electronic gaming machine to display the selection game. In one such embodiment, the gaming system causes a supplemental display device, such as a top box, of an electronic gaming machine to display the selection game. In another such embodiment, the gaming system causes the selection game to be displayed in one or more service windows or pop-up screens. In another embodiment, in addition or in alternative to each electronic gaming machine displaying the selection game, one or more players, the gaming system causes one or more community or overhead display devices to display part or all of the selection game to one or more other players or bystanders either at a gaming establishment or viewing over a network, such as the internet. In another embodiment, in addition or in alternative to each electronic gaming machine displaying the selection game, the gaming system causes one or more internet sites to each display the selection game such that a player is enabled to log on from a personal web browser. In another such embodiment, the gaming system enables the player to play one or more games on one device while viewing the selection game from another device, such as a desktop or laptop computer.

In one embodiment, the selection game is a persistent or ongoing game. In this embodiment, following the occurrence of a selection game triggering event, such as an initiation of a gaming session, the gaming system continuously displays the selection game over one or more plays of one or more primary games. That is, following an occurrence of a selection game triggering event, the gaming system displays the selection game persisting from one play of a primary game to another play of the primary game. It should thus be appreciated that in this embodiment, prior to one or more players initiating any plays of any games, the gaming system displays the selection game to such players.

In one embodiment, the selection game is personal to the player playing the selection game. In this embodiment, if the player leaves the electronic gaming machine, the gaming system stores the current state of the player's personal selection game, wherein when the player later returns to an electronic gaming machine, the gaming system recalls the stored state of the player's personal selection game.

In different embodiments, one or more awards provided in association with one or more primary game plays, one or more secondary game plays, and/or one or more community game plays include one or more of: a quantity of monetary credits, a quantity of non-monetary credits, a quantity of promotional credits, a quantity of player tracking points, a progressive award, a modifier, such as a multiplier, a quantity of free plays of one or more games, a quantity of plays of one or more secondary or bonus games, a multiplier of a quantity of free plays of a game, one or more lottery based awards, such as lottery or drawing tickets, a wager match for one or more plays of one or more games, an increase in the average expected payback percentage for one or more plays of one or more games, one or more comps, such as a free dinner, a free night's stay at a hotel, a high value product such as a free car, or a low value product such as a free teddy bear, one or more bonus credits usable for online play, a lump sum of player tracking points or credits, a multiplier for player tracking points or credits, an increase in a membership or player tracking level, one or more coupons or promotions usable within and/or outside of the gaming establishment (e.g., a 20% off coupon for use at a convenience store), virtual goods associated with the gaming system, virtual goods not associated with the gaming system, an access code usable to unlock content on an internet.

It should be appreciated that in different embodiments, one or more of:

i. whether a selection game triggering event occurs;
ii. when the selection game triggering event occurs;
iii. which awards to display;
iv. a quantity of awards to display;
v. where in the selection game display to display each award;
vi. what type of award value to associate with each award;
vii. what award value to associate with each award;
viii. whether the award value associated with each award should change;
ix. when to modify the award value associated with each award;
x. whether to remove a displayed selection from a play of the selection game;
xi. when to remove a displayed selection from a play of the selection game;
xii. whether a selection game termination event occurs;
xiii. what the selection game termination event is;
xiv. a quantity of player picks in each level of the selection game;
xv. a quantity of designated picks in each level of the selection game;
xvi. a quantity of levels of the selection game;
xvii. a threshold value associated with each level of the selection game;
xviii. modifier values for each level of the selection game;
xix. when the selection game termination event occurs; and/or
xx. any determination disclosed herein;

is/are predetermined, randomly determined, randomly determined based on one or more weighted percentages, determined based on a generated symbol or symbol combination, determined independent of a generated symbol or symbol combination, determined based on a random determination by the central controller, determined independent of a random determination by the central controller, determined based on a random determination at the gaming system, determined independent of a random determination at the gaming system, determined based on at least one play of at least one game, determined independent of at least one play of at least one game, determined based on a player's selection or input, determined independent of a player's selection or input, determined based on one or more side wagers placed, determined independent of one or more side wagers placed, determined based on the player's primary game wager, determined independent of the player's primary game wager, determined based on time (such as the time of day), determined independent of time (such as the time of day), determined based on an amount of coin-in accumulated in one or more pools, determined independent of an amount of coin-in accumulated in one or more pools, determined based on a status of the player (i.e., a player tracking status), determined independent of a status of the player (i.e., a player tracking status), determined based on one or more other determinations disclosed herein, determined independent of any other determination disclosed herein or determined based on any other suitable method or criteria.

Gaming Systems

It should be appreciated that the above-described embodiments of the present disclosure may be implemented in accordance with or in conjunction with one or more of a variety of different types of gaming systems, such as, but not limited to, those described below.

The present disclosure contemplates a variety of different gaming systems each having one or more of a plurality of different features, attributes, or characteristics. It should be appreciated that a "gaming system" as used herein refers to various configurations of: (a) one or more central servers, central controllers, or remote hosts; (b) one or more electronic gaming machines ("EGMs"); and/or (c) one or more personal gaming devices, such as desktop computers, laptop computers, tablet computers or computing devices, personal digital assistants (PDAs), mobile telephones such as smart phones, and other mobile computing devices.

Thus, in various embodiments, the gaming system of the present disclosure includes: (a) one or more EGMs in combination with one or more central servers, central controllers, or remote hosts; (b) one or more personal gaming devices in combination with one or more central servers, central controllers, or remote hosts; (c) one or more personal gaming devices in combination with one or more EGMs; (d) one or more personal gaming devices, one or more EGMs, and one or more central servers, central controllers, or remote hosts in combination with one another; (e) a single EGM; (f) a plurality of EGMs in combination with one another; (g) a single personal gaming device; (h) a plurality of personal gaming devices in combination with one another; (i) a single central server, central controller, or remote host; and/or (j) a plurality of central servers, central controllers, or remote hosts in combination with one another.

For brevity and clarity, each EGM and each personal gaming device of the present disclosure is collectively referred herein as an "EGM." Additionally, for brevity and clarity, unless specifically stated otherwise, "EGM" as used herein represents one EGM or a plurality of EGMs, and "central server, central controller, or remote host" as used herein represents one central server, central controller, or remote host or a plurality of central servers, central controllers, or remote hosts.

Figure 3A:
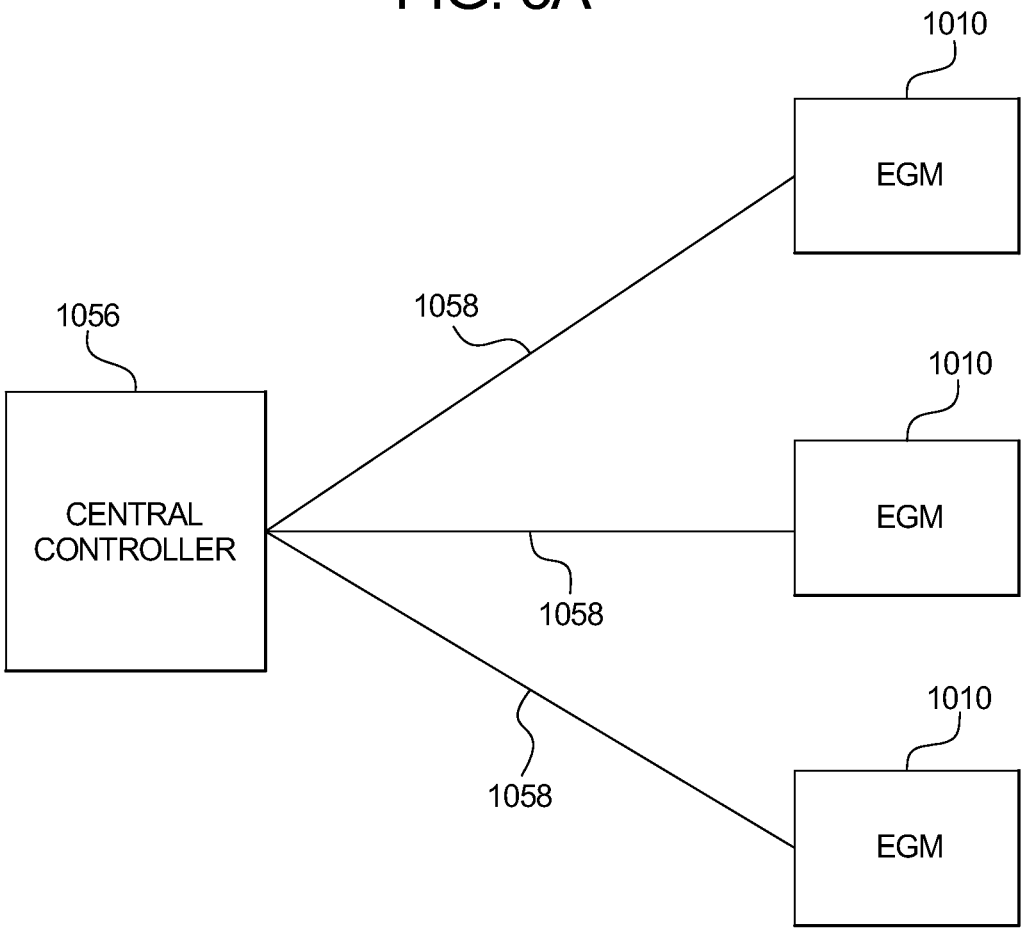
FIG. 3A is a schematic block diagram of one embodiment of a network configuration of the gaming system disclosed herein.

As noted above, in various embodiments, the gaming system includes an EGM in combination with a central server, central controller, or remote host. In such embodiments, the EGM is configured to communicate with the central server, central controller, or remote host through a data network or remote communication link. In certain such embodiments, the EGM is configured to communicate with another EGM through the same data network or remote communication link or through a different data network or remote communication link. For example, the gaming system illustrated in FIG. 3A includes a plurality of EGMs 1010 that are each configured to communicate with a central server, central controller, or remote host 1056 through a data network 1058.

In certain embodiments in which the gaming system includes an EGM in combination with a central server, central controller, or remote host, the central server, central controller, or remote host is any suitable computing device (such as a server) that includes at least one processor and at least one memory device or storage device. As further described herein, the EGM includes at least one EGM processor configured to transmit and receive data or signals representing events, messages, commands, or any other suitable information between the EGM and the central server, central controller, or remote host. The at least one processor of that EGM is configured to execute the events, messages, or commands represented by such data or signals in conjunction with the operation of the EGM. Moreover, the at least one processor of the central server, central controller, or remote host is configured to transmit and receive data or signals representing events, messages, commands, or any other suitable information between the central server, central controller, or remote host and the EGM. The at least one processor of the central server, central controller, or remote host is configured to execute the events, messages, or commands represented by such data or signals in conjunction with the operation of the central server, central controller, or remote host. It should be appreciated that one, more, or each of the functions of the central server, central controller, or remote host may be performed by the at least one processor of the EGM. It should be further appreciated that one, more, or each of the functions of the at least one processor of the EGM may be performed by the at least one processor of the central server, central controller, or remote host.

In certain such embodiments, computerized instructions for controlling any games (such as any primary or base games and/or any secondary or bonus games) displayed by the EGM are executed by the central server, central controller, or remote host. In such "thin client" embodiments, the central server, central controller, or remote host remotely controls any games (or other suitable interfaces) displayed by the EGM, and the EGM is utilized to display such games (or suitable interfaces) and to receive one or more inputs or commands. In other such embodiments, computerized instructions for controlling any games displayed by the EGM are communicated from the central server, central controller, or remote host to the EGM and are stored in at least one memory device of the EGM. In such "thick client" embodiments, the at least one processor of the EGM executes the computerized instructions to control any games (or other suitable interfaces) displayed by the EGM.

In various embodiments in which the gaming system includes a plurality of EGMs, one or more of the EGMs are thin client EGMs and one or more of the EGMs are thick client EGMs. In other embodiments in which the gaming system includes one or more EGMs, certain functions of one or more of the EGMs are implemented in a thin client environment, and certain other functions of one or more of the EGMs are implemented in a thick client environment. In one such embodiment in which the gaming system includes an EGM and a central server, central controller, or remote host, computerized instructions for controlling any primary or base games displayed by the EGM are communicated from the central server, central controller, or remote host to the EGM in a thick client configuration, and computerized instructions for controlling any secondary or bonus games or other functions displayed by the EGM are executed by the central server, central controller, or remote host in a thin client configuration.

In certain embodiments in which the gaming system includes: (a) an EGM configured to communicate with a central server, central controller, or remote host through a data network; and/or (b) a plurality of EGMs configured to communicate with one another through a data network, the data network is a local area network (LAN) in which the EGMs are located substantially proximate to one another and/or the central server, central controller, or remote host. In one example, the EGMs and the central server, central controller, or remote host are located in a gaming establishment or a portion of a gaming establishment.

In other embodiments in which the gaming system includes: (a) an EGM configured to communicate with a central server, central controller, or remote host through a data network; and/or (b) a plurality of EGMs configured to communicate with one another through a data network, the data network is a wide area network (WAN) in which one or more of the EGMs are not necessarily located substantially proximate to another one of the EGMs and/or the central server, central controller, or remote host. For example, one or more of the EGMs are located: (a) in an area of a gaming establishment different from an area of the gaming establishment in which the central server, central controller, or remote host is located; or (b) in a gaming establishment different from the gaming establishment in which the central server, central controller, or remote host is located. In another example, the central server, central controller, or remote host is not located within a gaming establishment in which the EGMs are located. It should be appreciated that in certain embodiments in which the data network is a WAN, the gaming system includes a central server, central controller, or remote host and an EGM each located in a different gaming establishment in a same geographic area, such as a same city or a same state. It should be appreciated that gaming systems in which the data network is a WAN are substantially identical to gaming systems in which the data network is a LAN, though the quantity of EGMs in such gaming systems may vary relative to one another.

In further embodiments in which the gaming system includes: (a) an EGM configured to communicate with a central server, central controller, or remote host through a data network; and/or (b) a plurality of EGMs configured to communicate with one another through a data network, the data network is an internet or an intranet. In certain such embodiments, an internet browser of the EGM is usable to access an internet game page from any location where an internet connection is available. In one such embodiment, after the internet game page is accessed, the central server, central controller, or remote host identifies a player prior to enabling that player to place any wagers on any plays of any wagering games. In one example, the central server, central controller, or remote host identifies the player by requiring a player account of the player to be logged into via an input of a unique username and password combination assigned to the player. It should be appreciated, however, that the central server, central controller, or remote host may identify the player in any other suitable manner, such as by validating a player tracking identification number associated with the player; by reading a player tracking card or other smart card inserted into a card reader (as described below); by validating a unique player identification number associated with the player by the central server, central controller, or remote host; or by identifying the EGM, such as by identifying the MAC address or the IP address of the internet facilitator. In various embodiments, once the central server, central controller, or remote host identifies the player, the central server, central controller, or remote host enables placement of one or more wagers on one or more plays of one or more primary or base games and/or one or more secondary or bonus games, and displays those plays via the internet browser of the EGM.

It should be appreciated that the central server, central server, or remote host and the EGM are configured to connect to the data network or remote communications link in any suitable manner. In various embodiments, such a connection is accomplished via: a conventional phone line or other data transmission line, a digital subscriber line (DSL), a T-1 line, a coaxial cable, a fiber optic cable, a wireless or wired routing device, a mobile communications network connection (such as a cellular network or mobile internet network), or any other suitable medium. It should be appreciated that the expansion in the quantity of computing devices and the quantity and speed of internet connections in recent years increases opportunities for players to use a variety of EGMs to play games from an ever-increasing quantity of remote sites. It should also be appreciated that the enhanced bandwidth of digital wireless communications may render such technology suitable for some or all communications, particularly if such communications are encrypted. Higher data transmission speeds may be useful for enhancing the sophistication and response of the display and interaction with players.

EGM Components

Figure 3B:
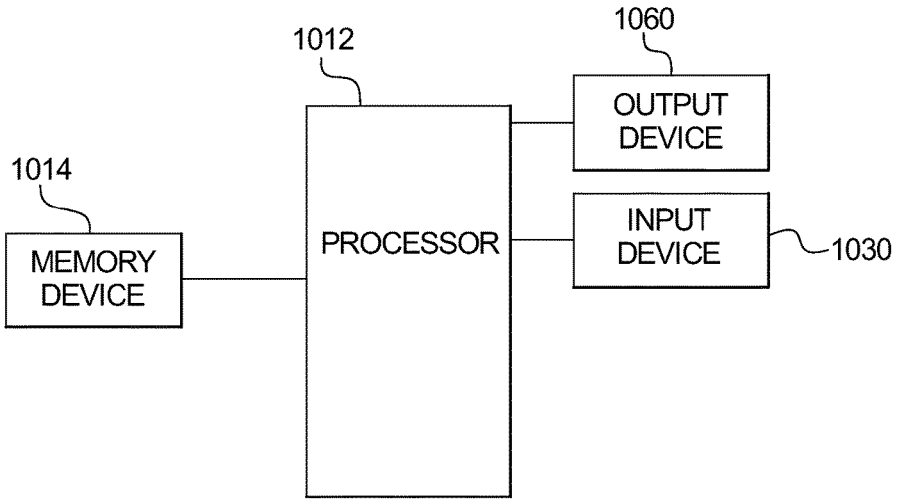
FIG. 3B is a schematic block diagram of one embodiment of an electronic configuration of the gaming system disclosed herein.

In various embodiments, an EGM includes at least one processor configured to operate with at least one memory device, at least one input device, and at least one output device. The at least one processor may be any suitable processing device or set of processing devices, such as a microprocessor, a microcontroller-based platform, a suitable integrated circuit, or one or more application-specific integrated circuits (ASICs). FIG. 3B illustrates an example EGM including a processor 1012.

As generally noted above, the at least one processor of the EGM is configured to communicate with, configured to access, and configured to exchange signals with at least one memory device or data storage device. In various embodiments, the at least one memory device of the EGM includes random access memory (RAM), which can include non-volatile RAM (NVRAM), magnetic RAM (MRAM), ferro-electric RAM (FeRAM), and other forms as commonly understood in the gaming industry. In other embodiments, the at least one memory device includes read only memory (ROM). In certain embodiments, the at least one memory device of the EGM includes flash memory and/or EEPROM (electrically erasable programmable read only memory). The example EGM illustrated in FIG. 3B includes a memory device 1014. It should be appreciated that any other suitable magnetic, optical, and/or semiconductor memory may operate in conjunction with the EGM disclosed herein. In certain embodiments, the at least one processor of the EGM and the at least one memory device of the EGM both reside within a cabinet of the EGM (as described below). In other embodiments, at least one of the at least one processor of the EGM and the at least one memory device of the EGM reside outside the cabinet of the EGM (as described below).

In certain embodiments, as generally described above, the at least one memory device of the EGM stores program code and instructions executable by the at least one processor of the EGM to control the EGM. The at least one memory device of the EGM also stores other operating data, such as image data, event data, input data, random number generators (RNGs) or pseudo-RNGs, paytable data or information, and/or applicable game rules that relate to the play of one or more games on the EGM (such as primary or base games and/or secondary or bonus games as described below). In various embodiments, part or all of the program code and/or the operating data described above is stored in at least one detachable or removable memory device including, but not limited to, a cartridge, a disk, a CD ROM, a DVD, a USB memory device, or any other suitable non-transitory computer readable medium. In certain such embodiments, an operator (such as a gaming establishment operator) and/or a player uses such a removable memory device in an EGM to implement at least part of the present disclosure. In other embodiments, part or all of the program code and/or the operating data is downloaded to the at least one memory device of the EGM through any suitable data network described above (such as an internet or intranet).

Figure 4A:
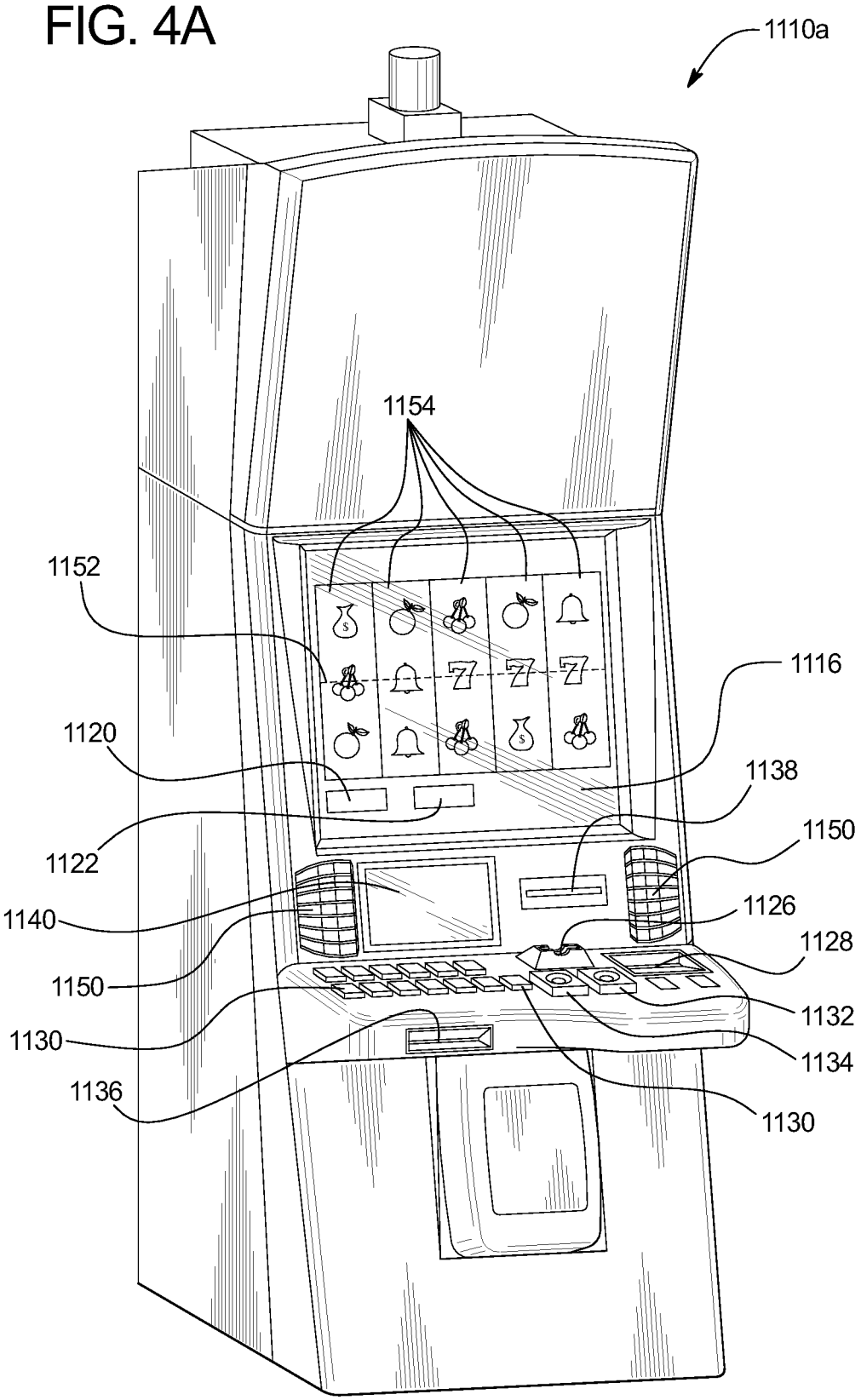
FIGS. 4A and 4B are perspective views of example alternative embodiments of the gaming system disclosed herein.
Figure 4B:
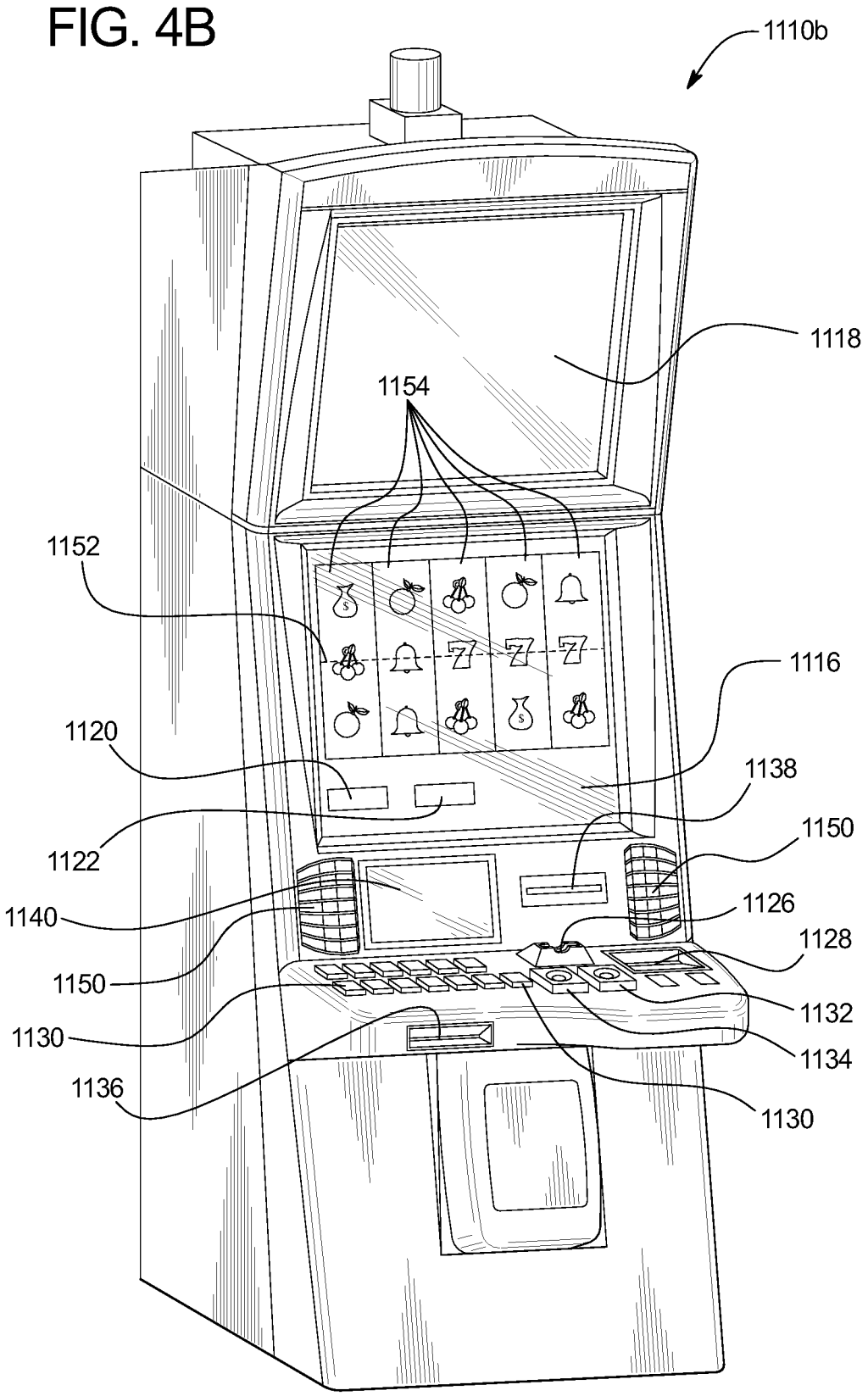

In various embodiments, the EGM includes one or more input devices. The input devices may include any suitable device that enables an input signal to be produced and received by the at least one processor of the EGM. The example EGM illustrated in FIG. 3B includes at least one input device 1030. One input device of the EGM is a payment device configured to communicate with the at least one processor of the EGM to fund the EGM. In certain embodiments, the payment device includes one or more of: (a) a bill acceptor into which paper money is inserted to fund the EGM; (b) a ticket acceptor into which a ticket or a voucher is inserted to fund the EGM; (c) a coin slot into which coins or tokens are inserted to fund the EGM; (d) a reader or a validator for credit cards, debit cards, or credit slips into which a credit card, debit card, or credit slip is inserted to fund the EGM; (e) a player identification card reader into which a player identification card is inserted to fund the EGM; or (f) any suitable combination thereof. FIGS. 4A and 4B illustrate example EGMs that each include the following payment devices: (a) a combined bill and ticket acceptor 1128, and (b) a coin slot 1126.

In one embodiment, the EGM includes a payment device configured to enable the EGM to be funded via an electronic funds transfer, such as a transfer of funds from a bank account. In another embodiment, the EGM includes a payment device configured to communicate with a mobile device of a player, such as a cell phone, a radio frequency identification tag, or any other suitable wired or wireless device, to retrieve relevant information associated with that player to fund the EGM. It should be appreciated that when the EGM is funded, the at least one processor determines the amount of funds entered and displays the corresponding amount on a credit display or any other suitable display as described below.

In various embodiments, one or more input devices of the EGM are one or more game play activation devices that are each used to initiate a play of a game on the EGM or a sequence of events associated with the EGM following appropriate funding of the EGM. The example EGMs illustrated in FIGS. 4A and 4B each include a game play activation device in the form of a game play initiation button 32. It should be appreciated that, in other embodiments, the EGM begins game play automatically upon appropriate funding rather than upon utilization of the game play activation device.

In certain embodiments, one or more input devices of the EGM are one or more wagering or betting devices. One such wagering or betting device is as a maximum wagering or betting device that, when utilized, causes a maximum wager to be placed. Another such wagering or betting device is a repeat the bet device that, when utilized, causes the previously-placed wager to be placed. A further such wagering or betting device is a bet one device. A bet is placed upon utilization of the bet one device. The bet is increased by one credit each time the bet one device is utilized. Upon the utilization of the bet one device, a quantity of credits shown in a credit display (as described below) decreases by one, and a number of credits shown in a bet display (as described below) increases by one. It should be appreciated that while the player's credit balance, the player's wager, and any awards are displayed as an amount of monetary credits or currency in the embodiments described herein, one or more of such player's credit balance, such player's wager, and any awards provided to such player may be for non-monetary credits, promotional credits, and/or player tracking points or credits.

In other embodiments, one input device of the EGM is a cash out device. The cash out device is utilized to receive a cash payment or any other suitable form of payment corresponding to a quantity of remaining credits of a credit display (as described below). The example EGMs illustrated in FIGS. 4A and 4B each include a cash out device in the form of a cash out button 1134.

In certain embodiments, one input device of the EGM is a touch-screen coupled to a touch-screen controller or other touch-sensitive display overlay to enable interaction with any images displayed on a display device (as described below). One such input device is a conventional touch-screen button panel. The touch-screen and the touch-screen controller are connected to a video controller. In these embodiments, signals are input to the EGM by touching the touch screen at the appropriate locations.

In various embodiments, one input device of the EGM is a sensor, such as a camera, in communication with the at least one processor of the EGM (and controlled by the at least one processor of the EGM in some embodiments) and configured to acquire an image or a video of a player using the EGM and/or an image or a video of an area surrounding the EGM.

In embodiments including a player tracking system, as further described below, one input device of the EGM is a card reader in communication with the at least one processor of the EGM. The example EGMs illustrated in FIGS. 4A and 4B each include a card reader 1138. The card reader is configured to read a player identification card inserted into the card reader.

In various embodiments, the EGM includes one or more output devices. The example EGM illustrated in FIG. 3B includes at least one output device 1060. One or more output devices of the EGM are one or more display devices configured to display any game(s) displayed by the EGM and any suitable information associated with such game(s). In certain embodiments, the display devices are connected to or mounted on a cabinet of the EGM (as described below). In various embodiments, the display devices serves as digital glass configured to advertise certain games or other aspects of the gaming establishment in which the EGM is located. In various embodiments, the EGM includes one or more of the following display devices: (a) a central display device; (b) a player tracking display configured to display various information regarding a player's player tracking status (as described below); (c) a secondary or upper display device in addition to the central display device and the player tracking display; (d) a credit display configured to display a current quantity of credits, amount of cash, account balance, or the equivalent; and (e) a bet display configured to display an amount wagered for one or more plays of one or more games. The example EGM illustrated in FIG. 4A includes a central display device 1116, a player tracking display 1140, a credit display 1120, and a bet display 1122. The example EGM illustrated in FIG. 4B includes a central display device 1116, an upper display device 1118, a player tracking display 1140, a player tracking display 1140, a credit display 1120, and a bet display 1122.

In various embodiments, the display devices include, without limitation: a monitor, a television display, a plasma display, a liquid crystal display (LCD), a display based on light emitting diodes (LEDs), a display based on a plurality of organic light-emitting diodes (OLEDs), a display based on polymer light-emitting diodes (PLEDs), a display based on a plurality of surface-conduction electron-emitters (SEDs), a display including a projected and/or reflected image, or any other suitable electronic device or display mechanism. In certain embodiments, as described above, the display device includes a touch-screen with an associated touch-screen controller. It should be appreciated that the display devices may be of any suitable sizes, shapes, and configurations.

The display devices of the EGM are configured to display one or more game and/or non-game images, symbols, and indicia. In certain embodiments, the display devices of the EGM are configured to display any suitable visual representation or exhibition of the movement of objects; dynamic lighting; video images; images of people, characters, places, things, and faces of cards; and the like. In certain embodiments, the display devices of the EGM are configured to display one or more video reels, one or more video wheels, and/or one or more video dice. In other embodiments, certain of the displayed images, symbols, and indicia are in mechanical form. That is, in these embodiments, the display device includes any electromechanical device, such as one or more rotatable wheels, one or more reels, and/or one or more dice, configured to display at least one or a plurality of game or other suitable images, symbols, or indicia.

In various embodiments, one output device of the EGM is a payout device. In these embodiments, when the cash out device is utilized as described above, the payout device causes a payout to be provided to the player. In one embodiment, the payout device is one or more of: (a) a ticket generator configured to generate and provide a ticket or credit slip representing a payout, wherein the ticket or credit slip may be redeemed via a cashier, a kiosk, or other suitable redemption system; (b) a note generator configured to provide paper currency; (c) a coin generator configured to provide coins or tokens in a coin payout tray; and (d) any suitable combination thereof. The example EGMs illustrated in FIGS. 4A and 4B each include ticket generator 1136. In one embodiment, the EGM includes a payout device configured to fund an electronically recordable identification card or smart card or a bank account via an electronic funds transfer.

In certain embodiments, one output device of the EGM is a sound generating device controlled by one or more sound cards. In one such embodiment, the sound generating device includes one or more speakers or other sound generating hardware and/or software for generating sounds, such as by playing music for any games or by playing music for other modes of the EGM, such as an attract mode. The example EGMs illustrated in FIGS. 4A and 4B each include a plurality of speakers 1150. In another such embodiment, the EGM provides dynamic sounds coupled with attractive multimedia images displayed on one or more of the display devices to provide an audio-visual representation or to otherwise display full-motion video with sound to attract players to the EGM. In certain embodiments, the EGM displays a sequence of audio and/or visual attraction messages during idle periods to attract potential players to the EGM. The videos may be customized to provide any appropriate information.

In various embodiments, the EGM includes a plurality of communication ports configured to enable the at least one processor of the EGM to communicate with and to operate with external peripherals, such as: accelerometers, arcade sticks, bar code readers, bill validators, biometric input devices, bonus devices, button panels, card readers, coin dispensers, coin hoppers, display screens or other displays or video sources, expansion buses, information panels, keypads, lights, mass storage devices, microphones, motion sensors, motors, printers, reels, SCSI ports, solenoids, speakers, thumbsticks, ticket readers, touch screens, trackballs, touchpads, wheels, and wireless communication devices. At least U.S. Patent Application Publication No. 2004/0254014 describes a variety of EGMs including one or more communication ports that enable the EGMs to communicate and operate with one or more external peripherals.

As generally described above, in certain embodiments, such as the example EGMs illustrated in FIGS. 4A and 4B, the EGM has a support structure, housing, or cabinet that provides support for a plurality of the input device and the output devices of the EGM. Further, the EGM is configured such that a player may operate it while standing or sitting. In various embodiments, the EGM is positioned on a base or stand, or is configured as a pub-style tabletop game (not shown) that a player may operate typically while sitting. As illustrated by the different example EGMs shown in FIGS. 4A and 4B, EGMs may have varying cabinet and display configurations.

It should be appreciated that, in certain embodiments, the EGM is a device that has obtained approval from a regulatory gaming commission, and in other embodiments, the EGM is a device that has not obtained approval from a regulatory gaming commission.

As explained above, for brevity and clarity, both the EGMs and the personal gaming devices of the present disclosure are collectively referred to herein as "EGMs." Accordingly, it should be appreciated that certain of the example EGMs described above include certain elements that may not be included in all EGMs. For example, the payment device of a personal gaming device such as a mobile telephone may not include a coin acceptor, while in certain instances the payment device of an EGM located in a gaming establishment may include a coin acceptor.

Operation of Primary or Base Games and/or Secondary or Bonus Games

In various embodiments, an EGM may be implemented in one of a variety of different configurations. In various embodiments, the EGM may be implemented as one of: (a) a dedicated EGM wherein computerized game programs executable by the EGM for controlling any primary or base games (referred to herein as "primary games") and/or any secondary or bonus games or other functions (referred to herein as "secondary games") displayed by the EGM are provided with the EGM prior to delivery to a gaming establishment or prior to being provided to a player; and (b) a changeable EGM wherein computerized game programs executable by the EGM for controlling any primary games and/or secondary games displayed by the EGM are downloadable to the EGM through a data network or remote communication link after the EGM is physically located in a gaming establishment or after the EGM is provided to a player.

As generally explained above, in various embodiments in which the gaming system includes a central server, central controller, or remote host and a changeable EGM, the at least one memory device of the central server, central controller, or remote host stores different game programs and instructions executable by the at least one processor of the changeable EGM to control one or more primary games and/or secondary games displayed by the changeable EGM. More specifically, each such executable game program represents a different game or a different type of game that the at least one changeable EGM is configured to operate. In one example, certain of the game programs are executable by the changeable EGM to operate games having the same or substantially the same game play but different paytables. In different embodiments, each executable game program is associated with a primary game, a secondary game, or both. In certain embodiments, an executable game program is executable by the at least one processor of the at least one changeable EGM as a secondary game to be played simultaneously with a play of a primary game (which may be downloaded to or otherwise stored on the at least one changeable EGM), or vice versa.

In operation of such embodiments, the central server, central controller, or remote host is configured to communicate one or more of the stored executable game programs to the at least one processor of the changeable EGM. In different embodiments, a stored executable game program is communicated or delivered to the at least one processor of the changeable EGM by: (a) embedding the executable game program in a device or a component (such as a microchip to be inserted into the changeable EGM); (b) writing the executable game program onto a disc or other media; or (c) uploading or streaming the executable game program over a data network (such as a dedicated data network). After the executable game program is communicated from the central server, central controller, or remote host to the changeable EGM, the at least one processor of the changeable EGM executes the executable game program to enable the primary game and/or the secondary game associated with that executable game program to be played using the display device(s) and/or the input device(s) of the changeable EGM. That is, when an executable game program is communicated to the at least one processor of the changeable EGM, the at least one processor of the changeable EGM changes the game or the type of game that may be played using the changeable EGM.

In certain embodiments, the gaming system randomly determines any game outcome(s) (such as a win outcome) and/or award(s) (such as a quantity of credits to award for the win outcome) for a play of a primary game and/or a play of a secondary game based on probability data. In certain such embodiments, this random determination is provided through utilization of an RNG, such as a true RNG or a pseudo RNG, or any other suitable randomization process. In one such embodiment, each game outcome or award is associated with a probability, and the gaming system generates the game outcome(s) and/or the award(s) to be provided based on the associated probabilities. In these embodiments, since the gaming system generates game outcomes and/or awards randomly or based on one or more probability calculations, there is no certainty that the gaming system will ever provide any specific game outcome and/or award.

In certain embodiments, the gaming system maintains one or more predetermined pools or sets of predetermined game outcomes and/or awards. In certain such embodiments, upon generation or receipt of a game outcome and/or award request, the gaming system independently selects one of the predetermined game outcomes and/or awards from the one or more pools or sets. The gaming system flags or marks the selected game outcome and/or award as used. Once a game outcome or an award is flagged as used, it is prevented from further selection from its respective pool or set; that is, the gaming system does not select that game outcome or award upon another game outcome and/or award request. The gaming system provides the selected game outcome and/or award. At least U.S. Pat. Nos. 7,470,183; 7,563,163; and 7,833,092 and U.S. Patent Application Publication Nos. 2005/0148382, 2006/0094509, and 2009/0181743 describe various examples of this type of award determination.

In certain embodiments, the gaming system determines a predetermined game outcome and/or award based on the results of a bingo, keno, or lottery game. In certain such embodiments, the gaming system utilizes one or more bingo, keno, or lottery games to determine the predetermined game outcome and/or award provided for a primary game and/or a secondary game. The gaming system is provided or associated with a bingo card. Each bingo card consists of a matrix or array of elements, wherein each element is designated with separate indicia. After a bingo card is provided, the gaming system randomly selects or draws a plurality of the elements. As each element is selected, a determination is made as to whether the selected element is present on the bingo card. If the selected element is present on the bingo card, that selected element on the provided bingo card is marked or flagged. This process of selecting elements and marking any selected elements on the provided bingo cards continues until one or more predetermined patterns are marked on one or more of the provided bingo cards. After one or more predetermined patterns are marked on one or more of the provided bingo cards, game outcome and/or award is determined based, at least in part, on the selected elements on the provided bingo cards. At least U.S. Pat. Nos. 7,753,774; 7,731,581; 7,955,170; and 8,070,579 and U.S. Patent Application Publication No. 2011/0028201 describe various examples of this type of award determination.

In certain embodiments in which the gaming system includes a central server, central controller, or remote host and an EGM, the EGM is configured to communicate with the central server, central controller, or remote host for monitoring purposes only. In such embodiments, the EGM determines the game outcome(s) and/or award(s) to be provided in any of the manners described above, and the central server, central controller, or remote host monitors the activities and events occurring on the EGM. In one such embodiment, the gaming system includes a real-time or online accounting and gaming information system configured to communicate with the central server, central controller, or remote host. In this embodiment, the accounting and gaming information system includes: (a) a player database for storing player profiles, (b) a player tracking module for tracking players (as described below), and (c) a credit system for providing automated transactions. At least U.S. Pat. No. 6,913,534 and U.S. Patent Application Publication No. 2006/0281561 describe various examples of such accounting systems.

As noted above, in various embodiments, the gaming system includes one or more executable game programs executable by at least one processor of the gaming system to provide one or more primary games and one or more secondary games. The primary game(s) and the secondary game(s) may comprise any suitable games and/or wagering games, such as, but not limited to: electro-mechanical or video slot or spinning reel type games; video card games such as video draw poker, multi-hand video draw poker, other video poker games, video blackjack games, and video baccarat games; video keno games; video bingo games; and video selection games.

In certain embodiments in which the primary game is a slot or spinning reel type game, the gaming system includes one or more reels in either an electromechanical form with mechanical rotating reels or in a video form with simulated reels and movement thereof. Each reel displays a plurality of indicia or symbols, such as bells, hearts, fruits, numbers, letters, bars, or other images that typically correspond to a theme associated with the gaming system. In certain such embodiments, the gaming system includes one or more paylines associated with the reels. The example EGMs shown in FIGS. 4A and 4B each include a payline 1152 and a plurality of reels 1156. In certain embodiments, one or more of the reels are independent reels or unisymbol reels. In such embodiments, each independent reel generates and displays one symbol.

In various embodiments, one or more of the paylines is horizontal, vertical, circular, diagonal, angled, or any suitable combination thereof. In other embodiments, each of one or more of the paylines is associated with a plurality of adjacent symbol display positions on a requisite number of adjacent reels. In one such embodiment, one or more paylines are formed between at least two symbol display positions that are adjacent to each other by either sharing a common side or sharing a common corner (i.e., such paylines are connected paylines). The gaming system enables a wager to be placed on one or more of such paylines to activate such paylines. In other embodiments in which one or more paylines are formed between at least two adjacent symbol display positions, the gaming system enables a wager to be placed on a plurality of symbol display positions, which activates those symbol display positions.

In various embodiments, the gaming system provides one or more awards after a spin of the reels when specified types and/or configurations of the indicia or symbols on the reels occur on an active payline or otherwise occur in a winning pattern, occur on the requisite number of adjacent reels, and/or occur in a scatter pay arrangement.

In certain embodiments, the gaming system employs a ways to win award determination. In these embodiments, any outcome to be provided is determined based on a number of associated symbols that are generated in active symbol display positions on the requisite number of adjacent reels (i.e., not on paylines passing through any displayed winning symbol combinations). If a winning symbol combination is generated on the reels, one award for that occurrence of the generated winning symbol combination is provided. At least U.S. Pat. No. 8,012,011 and U.S. Patent Application Publication Nos. 2008/0108408 and 2008/0132320 describe various examples of ways to win award determinations.

In various embodiments, the gaming system includes a progressive award. Typically, a progressive award includes an initial amount and an additional amount funded through a portion of each wager placed to initiate a play of a primary game. When one or more triggering events occurs, the gaming system provides at least a portion of the progressive award. After the gaming system provides the progressive award, an amount of the progressive award is reset to the initial amount and a portion of each subsequent wager is allocated to the next progressive award. At least U.S. Pat. Nos. 5,766,079; 7,585,223; 7,651,392; 7,666,093; 7,780,523; and 7,905,778 and U.S. Patent Application Publication Nos. 2008/0020846, 2009/0123364, 2009/0123363, and 2010/0227677 describe various examples of different progressive gaming systems.

As generally noted above, in addition to providing winning credits or other awards for one or more plays of the primary game(s), in various embodiments the gaming system provides credits or other awards for one or more plays of one or more secondary games. The secondary game typically enables a prize or payout in to be obtained addition to any prize or payout obtained through play of the primary game(s). The secondary game(s) typically produces a higher level of player excitement than the primary game(s) because the secondary game(s) provides a greater expectation of winning than the primary game(s) and is accompanied with more attractive or unusual features than the primary game(s). It should be appreciated that the secondary game(s)

may be any type of suitable game, either similar to or completely different from the primary game.

In various embodiments, the gaming system automatically provides or initiates the secondary game upon the occurrence of a triggering event or the satisfaction of a qualifying condition. In other embodiments, the gaming system initiates the secondary game upon the occurrence of the triggering event or the satisfaction of the qualifying condition and upon receipt of an initiation input. In certain embodiments, the triggering event or qualifying condition is a selected outcome in the primary game(s) or a particular arrangement of one or more indicia on a display device for a play of the primary game(s), such as a "BONUS" symbol appearing on three adjacent reels along a payline following a spin of the reels for a play of the primary game. In other embodiments, the triggering event or qualifying condition occurs based on a certain amount of game play (such as number of games, number of credits, amount of time) being exceeded, or based on a specified number of points being earned during game play. It should be appreciated that any suitable triggering event or qualifying condition or any suitable combination of a plurality of different triggering events or qualifying conditions may be employed.

In other embodiments, at least one processor of the gaming system randomly determines when to provide one or more plays of one or more secondary games. In one such embodiment, no apparent reason is provided for the providing of the secondary game. In this embodiment, qualifying for a secondary game is not triggered by the occurrence of an event in any primary game or based specifically on any of the plays of any primary game. That is, qualification is provided without any explanation or, alternatively, with a simple explanation. In another such embodiment, the gaming system determines qualification for a secondary game at least partially based on a game triggered or symbol triggered event, such as at least partially based on play of a primary game.

In various embodiments, after qualification for a secondary game has been determined, the secondary game participation may be enhanced through continued play on the primary game. Thus, in certain embodiments, for each secondary game qualifying event, such as a secondary game symbol, that is obtained, a given number of secondary game wagering points or credits is accumulated in a "secondary game meter" configured to accrue the secondary game wagering credits or entries toward eventual participation in the secondary game. In one such embodiment, the occurrence of multiple such secondary game qualifying events in the primary game results in an arithmetic or exponential increase in the number of secondary game wagering credits awarded. In another such embodiment, any extra secondary game wagering credits may be redeemed during the secondary game to extend play of the secondary game.

In certain embodiments, no separate entry fee or buy-in for the secondary game is required. That is, entry into the secondary game cannot be purchased; rather, in these embodiments entry must be won or earned through play of the primary game, thereby encouraging play of the primary game. In other embodiments, qualification for the secondary game is accomplished through a simple "buy-in." For example, qualification through other specified activities is unsuccessful, payment of a fee or placement of an additional wager "buys-in" to the secondary game. In certain embodiments, a separate side wager must be placed on the secondary game or a wager of a designated amount must be placed on the primary game to enable qualification for the secondary game. In these embodiments, the secondary game triggering event must occur and the side wager (or designated primary game wager amount) must have been placed for the secondary game to trigger.

In various embodiments in which the gaming system includes a plurality of EGMs, the EGMs are configured to communicate with one another to provide a group gaming environment. In certain such embodiments, the EGMs enable players of those EGMs to work in conjunction with one another, such as by enabling the players to play together as a team or group, to win one or more awards. In other such embodiments, the EGMs enable players of those EGMs to compete against one another for one or more awards. In one such embodiment, the EGMs enable the players of those EGMs to participate in one or more gaming tournaments for one or more awards. At least U.S. Patent Application Publication Nos. 2007/0123341, 2008/0070680, 2008/0176650, and 2009/0124363 describe various examples of different group gaming systems.

In various embodiments, the gaming system includes one or more player tracking systems. Such player tracking systems enable operators of the gaming system (such as casinos or other gaming establishments) to recognize the value of customer loyalty by identifying frequent customers and rewarding them for their patronage. Such a player tracking system is configured to track a player's gaming activity. In one such embodiment, the player tracking system does so through the use of player tracking cards. In this embodiment, a player is issued a player identification card that has an encoded player identification number that uniquely identifies the player. When the player's playing tracking card is inserted into a card reader of the gaming system to begin a gaming session, the card reader reads the player identification number off the player tracking card to identify the player. The gaming system timely tracks any suitable information or data relating to the identified player's gaming session. The gaming system also timely tracks when the player tracking card is removed to conclude play for that gaming session. In another embodiment, rather than requiring insertion of a player tracking card into the card reader, the gaming system utilizes one or more portable devices, such as a cell phone, a radio frequency identification tag, or any other suitable wireless device, to track when a gaming session begins and ends. In another embodiment, the gaming system utilizes any suitable biometric technology or ticket technology to track when a gaming session begins and ends.

In such embodiments, during one or more gaming sessions, the gaming system tracks any suitable information or data, such as any amounts wagered, average wager amounts, and/or the time at which these wagers are placed. In different embodiments, for one or more players, the player tracking system includes the player's account number, the player's card number, the player's first name, the player's surname, the player's preferred name, the player's player tracking ranking, any promotion status associated with the player's player tracking card, the player's address, the player's birthday, the player's anniversary, the player's recent gaming sessions, or any other suitable data. In various embodiments, such tracked information and/or any suitable feature associated with the player tracking system is displayed on a player tracking display. In various embodiments, such tracked information and/or any suitable feature associated with the player tracking system is displayed via one or more service windows that are displayed on the central display device and/or the upper display device. At least U.S. Pat. Nos. 6,722,985; 6,908,387; 7,311,605; 7,611,411; 7,617,151; and 8,057,298 describe various examples of player tracking systems.

It should be understood that various changes and modifications to the presently preferred embodiments described herein will be apparent to those skilled in the art. Such changes and modifications can be made without departing from the spirit and scope of the present subject matter and without diminishing its intended advantages. It is therefore intended that such changes and modifications be covered by the appended claims.

The invention is claimed as follows:

1. A dedicated electronic gaming machine comprising:

at least one display device;

a plurality of input devices including a payment acceptor;

at least one processor; and at least one memory device which stores a plurality of instructions, which when executed by the at least one processor, cause the at least one processor to:

(a) responsive to a physical item being received via the payment acceptor, establish a credit balance based, at least in part, on a monetary value associated with the received physical item, wherein the physical item is selected from the group consisting of: a ticket associated with the monetary value and a unit of currency, (b) responsive to a selection game triggering event occurring distinct from any placement of any wager on any play of any wagering game:

(i) determine a threshold award value for a level of a multiple level selection game, (ii) cause the at least one display device to display a plurality of selections, a plurality of said selections each being associated with one of a plurality of award values, (iii) for each of a first quantity of picks, receive, via at least one of the input devices, a pick of one of the displayed plurality of selections, (iv) for each of a second quantity of designated picks, receive, via the at least one of the input devices, a pick of at least one of the first quantity of picked selections, wherein the second quantity is lesser than or equal to the first quantity, (v) for each picked selection of the second quantity of designated picks:

(A) determine a modifier from a plurality of different modifiers, and (B) modify the award value based on the determined modifier, (vi) determine a level award value based on:

(A) the award values associated with each of the first quantity of picked selections that are not any of the second quantity of designated picks, and (B) the modified award values associated with each of the second quantity of designated picks, (vii) responsive to the determined level award value at least equaling the threshold award value for the level, repeat (b)(ii) to (b)(vii) at least once for another level of the multiple level selection game, said other level being associated with another threshold award value, and (c) responsive to a cashout input being received, cause an initiation of any payout associated with the credit balance.

2. The dedicated electronic gaming machine of claim 1, wherein (b)(ii) to (b)(vii) are repeated until a selection game termination event occurs.

3. The dedicated electronic gaming machine of claim 2, wherein the selection game termination event occurs when (b)(ii) to (b)(vii) have been repeated a designated number of times.

4. The dedicated electronic gaming machine of claim 2, wherein when executed by the at least one processor, the plurality of instructions cause the at least one processor to provide the determined level award value to the player after the selection game termination event occurs.

5. The dedicated electronic gaming machine of claim 1, wherein the modifier for each pick of the second quantity of designated picks includes at least one selected from the group consisting of: a play of a bonus game, a multiplier, and a plurality of credits.

6. The dedicated electronic gaming machine of claim 1, wherein the first quantity of picks for a first level of the multiple level selection game is the same as the first quantity of picks for a second level of the multiple level selection game.

7. The dedicated electronic gaming machine of claim 1, wherein the second quantity of designated picks for a first level of the multiple level selection game is the same as the second quantity of designated picks for a second level of the multiple level selection game.

8. A gaming system comprising:

at least one processor; and at least one memory device which stores a plurality of instructions, which when executed by the at least one processor following a receipt of data associated with a credit balance established responsive to an electronic funds transfer initiated from a mobile device and responsive to a selection game triggering event occurring distinct from any placement of any wager on any play of any wagering game, cause the at least one processor to:

(a) determine a threshold award value for a level of a multiple level selection game, (b) communicate, via a wireless network, data which results in a display device of the mobile device displaying a plurality of selections, a plurality of said selections each being associated with one of a plurality of award values, (c) for each of a first quantity of picks, receive data associated with a pick of one of the displayed plurality of selections, (d) for each of a second quantity of designated picks, receive data associated with a pick of at least one of the first quantity of picked selections, wherein the second quantity is lesser than or equal to the first quantity, (e) for each picked selection of the second quantity of designated picks:

(i) determine a modifier from a plurality of different modifiers, and (ii) modify the award value based on the determined modifier, (f) determine a level award value based on:

(i) the award values associated with each of the first quantity of picked selections that are not any of the second quantity of designated picks, and (ii) the modified award values associated with each of the second quantity of designated picks, and (g) responsive to the determined level award value at least equaling the threshold award value for the level, repeat (b) to (g) at least once for another level of the multiple level selection game, said other level being associated with another threshold award value.

9. The gaming system of claim 8, wherein (b) to (g) are repeated until a selection game termination event occurs.

10. The gaming system of claim 9, wherein the selection game termination event occurs when (b) to (g) have been repeated a designated number of times.

11. The gaming system of claim 9, wherein when executed by the at least one processor, the plurality of instructions cause the at least one processor to cause the determined level award value to be provided to the player after the selection game termination event occurs.

12. The gaming system of claim 8, wherein the modifier for each pick of the second quantity of designated picks includes at least one selected from the group consisting of: a play of a bonus game, a multiplier, and a plurality of credits.

13. The gaming system of claim 8, wherein the first quantity of picks for a first level of the multiple level selection game is the same as the first quantity of picks for a second level of the multiple level selection game.

14. The gaming system of claim 8, wherein the second quantity of designated picks for a first level of the multiple level selection game is the same as the second quantity of designated picks for a second level of the multiple level selection game.

15. The gaming system of claim 8, which transmits and receives data over a data network.

16. The gaming system of claim 15, wherein the data network is an internet.

17. A method of operating a dedicated electronic gaming machine, said method comprising:

(a) responsive to a physical item being received via a payment acceptor, establishing a credit balance based, at least in part, on a monetary value associated with the received physical item, wherein the physical item is selected from the group consisting of: a ticket associated with the monetary value and a unit of currency, (b) determining, by at least one processor, a threshold award value for a level of a multiple level selection game following an occurrence of a selection game triggering event distinct from any placement of any wager on any play of any wagering game, (c) displaying, by at least one display device, a plurality of selections, a plurality of said selections each being associated with one of a plurality of award values, (d) for each of a first quantity of picks, receiving a pick of one of the displayed plurality of selections, (e) for each of a second quantity of designated picks, receiving a pick of at least one of the first quantity of picked selections, wherein the second quantity is lesser than or equal to the first quantity, (f) for each picked selection of the second quantity of designated picks:

(i) determining, by the at least one processor, a modifier from a plurality of different modifiers, and (ii) modifying, by the at least one processor, the award value based on the determined modifier, (g) determining, by the at least one processor, a level award value based on:

(i) the award values associated with each of the first quantity of picked selections that are not any of the second quantity of designated picks, and (ii) the modified award values associated with each of the second quantity of designated picks, (h) responsive to the determined level award value at least equaling the threshold award value for the level, repeating (c) to (h) at least once for another level of the multiple level selection game, said other level being associated with another threshold award value, and (i) responsive to a cashout input being received, causing an initiation of any payout associated with the credit balance.

18. The method of claim 17, wherein (c) to (h) are repeated until a selection game termination event occurs.

19. The method of claim 18, wherein the selection game termination event occurs when (c) to (h) have been repeated a designated number of times.

20. The method of claim 18, further comprising providing the determined level award value to the player after the selection game termination event occurs.

21. The method of claim 17, wherein the modifier for each pick of the second quantity of designated picks includes at least one selected from the group consisting of: a play of a bonus game, a multiplier, and a plurality of credits.

22. The method of claim 17, wherein the first quantity of picks for a first level of the multiple level selection game is the same as the first quantity of picks for a second level of the multiple level selection game.

23. The method of claim 17, wherein the second quantity of designated picks for a first level of the multiple level selection game is the same as the second quantity of designated picks for a second level of the multiple level selection game.

24. The method of claim 17, which is executed through a data network.

25. The method of claim 24, wherein the data network is an internet.

* * * * *